United States Patent [19]

Klavan et al.

[11] 4,268,597

[45] * May 19, 1981

[54] METHOD, APPARATUS AND COMPOSITIONS FOR LIQUID DEVELOPMENT OF ELECTROSTATIC IMAGES

[75] Inventors: Irving L. Klavan, Teaneck; Peter J. Calabrese, Montville; Theron R. Finch, Northvale; Arthur Greenberg, Teaneck, all of N.J.; Robert P. McElroy, Spring Valley, N.Y.

[73] Assignee: Philip A. Hunt Chemical Corp., Palisades Park, N.J.

[ * ] Notice: The portion of the term of this patent subsequent to May 13, 1997, has been disclaimed.

[21] Appl. No.: 29,975

[22] Filed: Apr. 16, 1979

Related U.S. Application Data

[63] Continuation-in-part of Ser. No. 676,463, Apr. 13, 1976, abandoned, Ser. No. 916,041, Jun. 28, 1978, abandoned, and Ser. No. 916,042, Jun. 29, 1978, abandoned.

[51] Int. Cl.[3] ..... B05D 1/04

[52] U.S. Cl. ..... 430/102; 427/14.1; 430/117; 430/118; 430/119

[58] Field of Search ..... 427/15, 16, 14.1; 118/59, 661; 430/102, 117, 118, 119

[56] References Cited

U.S. PATENT DOCUMENTS

| | | | |
|---|---|---|---|
| 3,973,955 | 8/1976 | Ohno | 427/15 X |
| 4,023,898 | 5/1977 | Ohno | 427/15 X |
| 4,058,637 | 11/1977 | Ohno | 427/15 |

*Primary Examiner*—Bernard D. Pianalto

*Attorney, Agent, or Firm*—Kirschstein, Kirschstein, Ottinger & Cobrin

[57] ABSTRACT

A method, apparatus and composition for developing an electric field image associated with the surface of an object by disposing said surface close to but out of contact with a surface of a liquid developer at a development zone. An electric field is in the configuration of an image. The magnitude of the electric field, and the distance between the surface of the object and the liquid surface at the development zone are such that at the development zone the electric field at or approaching the zone, with or without the assistance of an external electric field, segmentally raises closely spaced tiny amorphous (individually non-image-defining) pseudopods from the liquid developer surface toward the surface of the object. The pseudopods rise from the liquid surface under the influence of a segment of the electric field image and the tips of the pseudopods and/or droplets separated from these tips arrive at the surface of the object under the influence of the same field. The pseudopods and/or droplets reach the surface of the object in a conjoint configuration that creates a physical material image. At the background where no physical material image is to be formed on the object, the electric field is so weak that no developing liquid reaches the object whereby at these portions of the field the surface of the object is not touched by the tips of the pseudopods or by the droplets and, hence, remains dry and unaltered. In general, the background remains in its virgin state and provides an excellent contrast for the developed image.

90 Claims, 40 Drawing Figures

FIG. 1
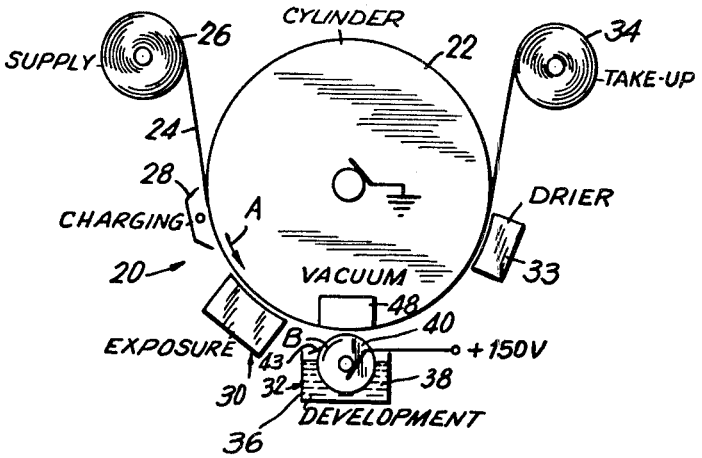
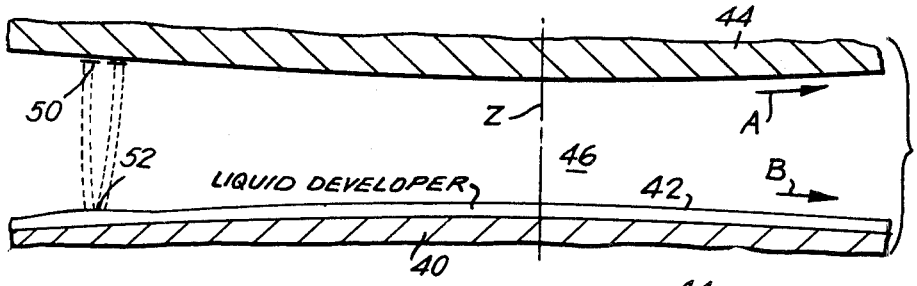
FIG. 2
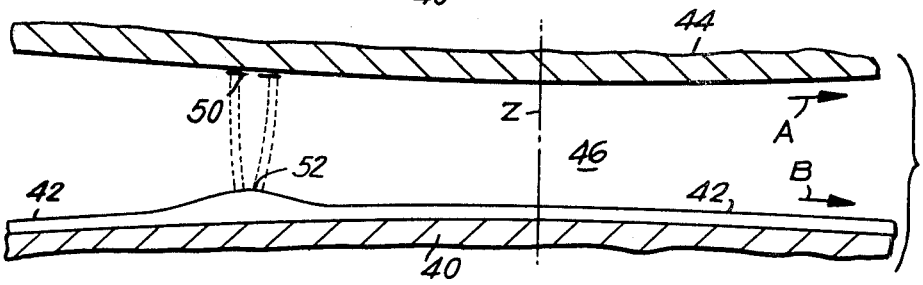
FIG. 3
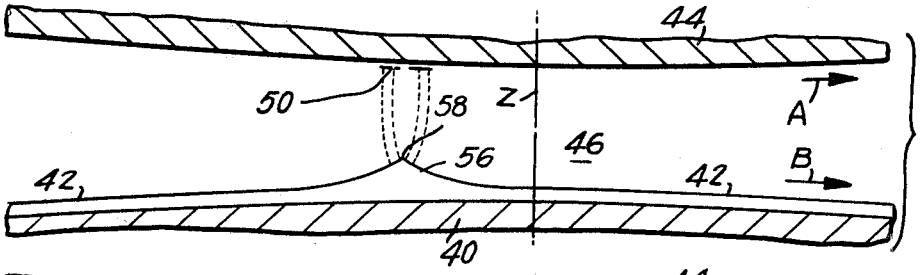
FIG. 4
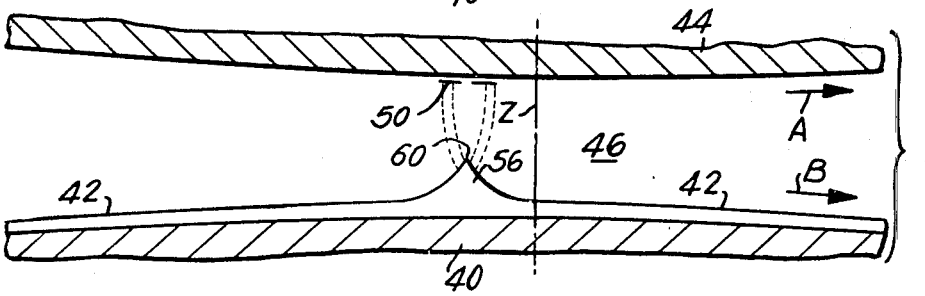
FIG. 5

FIG. 11
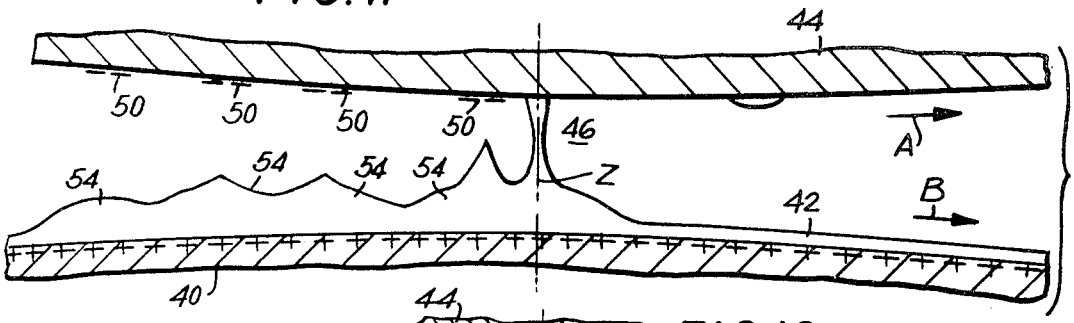
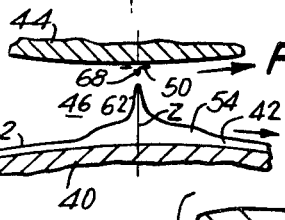
FIG. 16
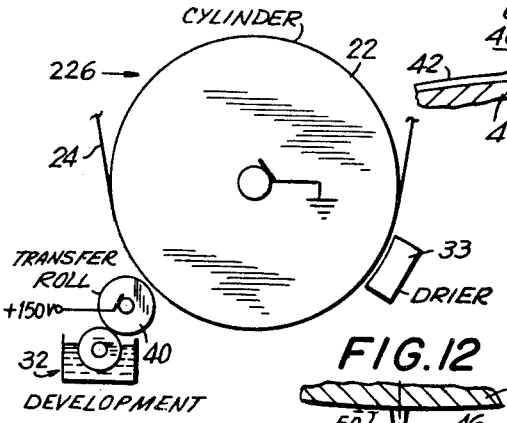
FIG. 40
FIG. 13
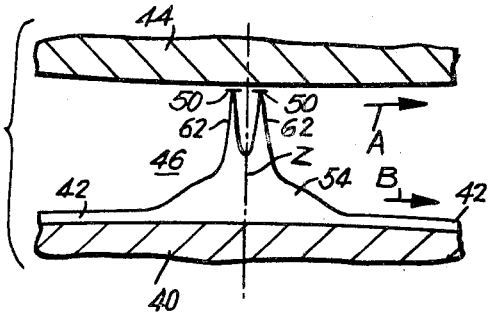
FIG. 12
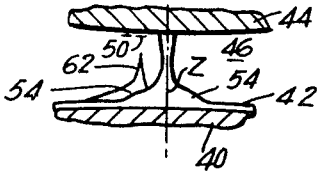
FIG. 14
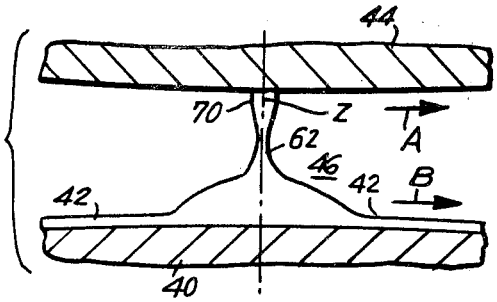
FIG. 17
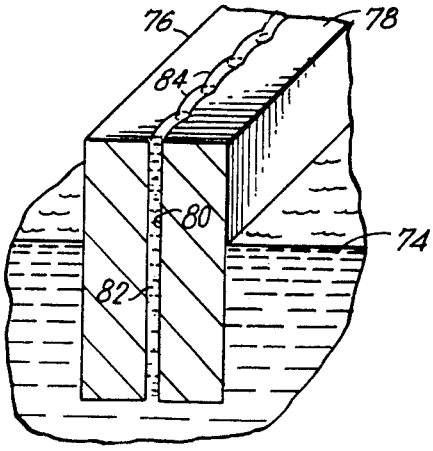
FIG. 15
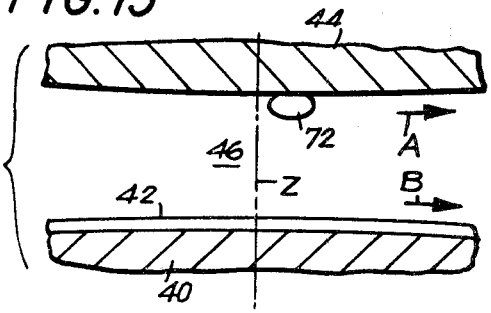

METHOD, APPARATUS AND COMPOSITIONS FOR LIQUID DEVELOPMENT OF ELECTROSTATIC IMAGES

RELATED APPLICATIONS

This application is a continuation-in-part of application Ser. Nos. 676,463, filed Apr. 13, 1976, 916,041, filed June 28, 1978, 916,042, filed June 29, 1978, all now abandoned.

BACKGROUND OF THE INVENTION

1. Field of the Invention

Liquid development of electric field images.

2. Description of the Prior Art

In the art of development of electrostatic images to which the present invention pertains (electrostatic images are one common embodiment of electric field images), the first step is to form on a carrier an electrostatic image which consists of many segments in various configurations such, for instance, as lines, characters, letters, symbols, etc., or an object or a picture, the segments being juxtaposed to uncharged segments of the carrier. The charged segments can be created in various fashions such, for example, as providing a carrier with a photoconductive layer, imposing a uniform electrostatic charge on the layer, and thereafter selectively discharging the electrostatic charge by exposure to a modulated beam of radiant energy, leaving an electrostatically charged image. Various other methods can be employed to form an electrostatic image such, for example, as providing a carrier which is a dielectric sheet and transferring a preformed electrostatic charge image to this sheet.

The current most popular system for developing an electrostatic image, particularly for so-called "office copier" machines, is that in which a developer is cascaded across the latent image. The developer is dry and includes a powder which coats carrier particles and is adhered thereto by electrostatic forces that usually are generated triboelectrically. The powder is preferentially attracted electrostatically from the carrier particles to the latent image, leaving powder on the latent image but not on uncharged segments.

In the most widely used office copiers the powder includes a thermoplastic material; the latent image is carried by a photoconductor surface other than an uncoated copy sheet such, for instance, as a selenium drum, and the powder, in the configuration of the ultimate image, is transferred from the drum to the uncoated copy sheet to which it is made to adhere, for example, by the application of heat sufficient to fuse the powder to the sheet but insufficient to deleteriously affect the sheet.

It also has been proposed to use as the carrier for the electrostatic image a flexible copy sheet coated with a photoconductive insulating layer and to fuse the powder directly to such a sheet.

It further has been proposed to develop an electrostatic image with a powder cloud, the powder being suspended in a gas which is blown against the latent image and selectively will deposit on the image largely to the exclusion of deposit on the uncharged segments.

Yet another system for developing electrostatic images employs a magnetic brush in which filaments of magnetically cohered carriers coated with toner or of magnetic toner particles are swept across a surface bearing an electrostatic image and toner is deposited on the image.

All the foregoing techniques are subject to various mechanical drawbacks such as intricate cascading equipment, intricate recirculating equipment for the toner in order to recapture the toner which cascades off the photoconductive layer and brings it back to a zone at which the cascading takes place, and intricate fusing equipment. The powder cloud developing method never has reached the point of widespread commercial acceptance. A further problem with dry developers was that the powder frequently adhered, for various reasons, to uncharged portions of the carrier, thus forming distracting deposits in the background where not such deposits should be present.

An alternate type of development which basically distinguishes from the dry development above described also has come into vogue, although not to the extent of dry development. This is the so-called "liquid" development. Liquid developing machines have been of various types. That most frequently used was one in which the electrostatic image was formed on a flexible carrier sheet having a photoconductive coating such, for example, as zinc oxide in a carrier such as polyvinylacetate. The sheet with the latent image thereon had applied to its entire image-carrying surface a liquid developer which most commonly constituted an organic liquid of a high resistivity with dispersed colored particles. The particles were electrophoretically attracted to the segments of the latent image on the sheet and massed at the charged image segments where they remained after the carrier left the liquid. Because the liquid not only contacted the portion of the sheet carrying the latent image but also the surface surrounding the image, i.e. the background, some particles adhered to the background where they appeared in the finished copy as objectionable spots or an overall background coloration, both of which were highly undesirable. The organic liquid evaporated to leave a dry developed image. The particles were thermoplastic and subsequently were fixed to the sheet by sufficient heat to fuse the particles without damaging the sheet. Surface adsorption and/or penetration sometimes were factors in fixing the particles to the sheet.

Other liquid developing machines employed an LTT principle (liquid toner transfer). In such machines a drum with a repeatedly usable photoconductive surface had an electrostatic image created thereon, after which the entire surface of the drum was progressively submerged in liquid developer at a development zone. Suspended insoluble particles in the liquid were electrophoretically attracted to the image segments on the drum as they traveled through the liquid and massed at the image segments where they remained after the drum left the development zone. The entire surface of the drum was wetted by the developer at the development zone. However, the attraction of the particles to the electrostatically charged image segments arranged the particles on the drum in the desired image configuration within the liquid film that covered the surface of the drum leaving the development zone. Subsequently, this wet image was transferred to an uncoated copy sheet. As in the liquid machines previously described, the LTT machines had an unwanted background coloration as well as unwanted small toned areas in the background.

A liquid developer machine is considerably simpler than a dry developer machine, but the liquid developer machine had many drawbacks such as the volatilization of organic liquid, the wetting of copy paper at background areas and the subsequent drying thereof either in the room or in an area exposed to the room, the necessity for ventilating the room in which the machine was located in order to prevent an objectionable concentration of the vapor of the organic liquid, and the tendency of the uncharged segments of the image to attract developer particles which result in a discoloration of the background and a loss of contrast as well as a loss of edge definition of the developed image.

Because in previous liquid developing machines the entire surface of the object carrying the electrostatic image was wetted by the developer and because this led to darkening of the background, it has been the practice to minimize such drawback by employing a low concentration of particles in the liquid developer, relying for contrast upon massing of particles where a visible image was to be created. Suppliers of toner reduced handling costs by selling liquid toner in a highly concentrated form (high weight-to-weight ratio of particles to liquid carrier). The concentrated toner was considerably diluted to the low concentrations desired for use in the field. A typical working toner had approximately 0.05% by weight of the particles.

Other problems with liquid developing equipment were: the creation of a trailing deposit of the particles beyond the edges of the developed image segments in the direction of travel of the carrier through the equipment, loss of fill (an inability to deposit enough particles from the liquid where a charged segment was of substantial dimension, for example, exceeding ¼" in any direction) and the susceptibility of the image to smudging due, in part, to incomplete setting of the image because of residual retention of the organic liquid.

Another drawback of liquid developing equipment was economic, and constituted the rather high cost of preparing a liquid developer. The particle size had to be extremely small, the dispersion of the particles in the organic liquid had to be substantially uniform, the particles had to be prevented from settling either upon standing in the machine between uses and over weekends, or on the shelf in a store-house or at a distributor, or even on the consumer's premises. The drawback of settling of the particles has been overcome by some manufacturers by the inclusion of dispersion agents, and by other manufacturers by special formulation of the solid contents of the liquid developer which made the insoluble particles part of an amphipathic molecule of which another part was soluble in the organic liquid. None of these improvements substantially reduced the cost of liquid developers.

It has been proposed to reduce the expense of providing a liquid developer by using water as a carrier in place of the organic liquid. This, also, of course, eliminated the problem of accumulation of vapor of the organic liquid in the vicinity of the office copier. The liquids proposed, generally, have been water containing a water-soluble dye. Due to the employment of a dye as the coloring agent, the problem of settling and dispersion was eliminated. However, to date, there have not been proposed any commercially acceptable liquid developing systems employing an aqueous carrier. The principal problem with these systems has been deposition of some of the liquid developer on uncharged portions of the photoconductor, with consequent loss of a clean background.

The lower cost of water-based liquid developers is not necessarily a controlling factor. Various commercial factors may dictate the use of a water-based developer or of an organic-liquid-based developer.

With respect to the machines which are specifically structured to make use of water-based developers, sundry pieces of equipment have been suggested. One was that disclosed in U.S. Pat. No. 3,084,043 in which a liquid developer was provided in the valleys of a surface, e.g. a roller surface, that included lands. The lands rode on the surface of a photoconductor and, under the influence of electrostatic force created by the segments of the electrostatic image, the developer crept up the sides of the valleys to contact such segments and, theoretically, did not creep up the sides of the valleys associated with segments where no charge existed. This system was proposed for both polar and non-polar developer liquids.

In another system using a liquid developer, see for example U.S. Pat. No. 3,886,900, it was proposed to have a developer roller turn in a tank of developing liquid and to provide an electrostatic field in a gap between the developer roller and the latent-image-bearing photoconductive surface. This field raised a swell, like a standing wave, of developer, which filled the gap between the roller and the photoconductive surface, the image being developed essentially by the same principle as that employed to develop a latent image using a liquid developer in which all portions of the photoconductive surface of a sheet carrying a latent image were treated with the developer, i.e. both charged and uncharged portions of the surface.

Another method proposed was that disclosed in patents such as U.S. Pat. No. 3,383,209 wherein valleys of a developer roller were partly filled with a developing liquid while the lands of the roller touched the photoconductive surface bearing the latent image. The theory of this system was that the developing liquid had a surface tension such as to render the liquid normally lyophobic with respect to the latent-image-carrying surface of the photoconductor, with the strength of the electrostatic field created by the segments of the latent image being sufficient to have the developer wet the portions of the surface having latent image segments thereon. U.S. Pat. No. 3,772,012 shows a similar arrangement.

Still another liquid developing system was proposed in U.S. Pat. No. 3,560,204 in which a developer roller turned partially submerged in a tray containing a liquid developer, the surface of the roller that left the developer passing beneath a photoconductor web having an electrostatic image thereon. The latent image consisted of charged segments juxtaposed to uncharged segments. The spacing, between the film of developing liquid pulled out of the tray by the roller as it turned and the uncharged segments of the image-bearing photoconductive surface, was quite small, not exceeding 3.2 mils. A bias charge was applied to the developer roller that sufficed to draw up unsupported columns of liquid developer each of which was in the shape of its associated uncharged segment to form an ink image on the photoconductive surface. These columns were said to rupture as the photoconductive surface and the film of liquid developer diverged when the roller turned away from its zone of closest proximity to the photoconductive surface.

The processes of all the prior commercial liquid developer systems have been found to leave marks on the background areas where no coloration, theoretically, should exist, and apparently it is for that reason that these processes have not found wide commercial favor despite many sophisticated modifications which have been proposed.

It will be appreciated that, in general, the common drawback of the various approaches to developing an electrostatic image with a liquid developer is the inability to maintain a virgin, i.e. untouched, and, therefore, unchanged, background segment where no color is supposed to exist.

Another liquid developer of the type in which the photoconductive surface bearing a latent image is exposed in its entirety or in part to a liquid is illustrated in U.S. Pat. No. 3,068,115 wherein droplets of a developing liquid are formed and drawn through a dielectric liquid in which the developer droplet is immiscible to said photoconductive surface which is submerged in the dielectric liquid, the droplets being attracted to the charged segments of the photoconductive surface. This arrangement, obviously, is unsuitable for commercial purposes since it is bulky, unwieldy, slow, requires different liquids in the same piece of equipment, and requires subsequent drying of the photoconductive surface.

The foregoing summarizes the main systems known to the inventors, it being appreciated that there are a large number of variants of these systems as well as other systems which are in no way relevant to the present invention.

SUMMARY OF THE INVENTION

Purposes of the Invention

It is a principal object of the present invention to provide a system for developing electric field images with a liquid developer in such a manner as to obtain a virtually clean and developer-untouched background.

It is another object of the invention to provide a system for developing electrostatic images with a liquid developer in such a manner as to obtain a virtually clean and developer-untouched background.

It is another object of the invention to provide a system of the character described which is capable of employing inexpensive liquid developers.

It is another object of the invention to provide a system of the character described which is capable of employing aqueous developers.

It is another object of the invention to provide a system of the character described which is capable of employing substantially non-volatile developers.

It is another object of the invention to provide a system of the character described which is capable of employing both water-based and organic-liquid-based developers.

It is another object of the invention to provide a system of the character described which can employ as the liquid developer virtually any kind of liquid so that liquids currently available on the market and employed for other purposes such, for instance, as inks and paints, readily can be utilized, even without modification, if desired.

It is another object of the invention to provide a system of the character described which is capable of being effected by the utilization of a very simple method and very simple machinery.

It is another object of the invention to provide a machine for a system of the character described which can be cleaned and maintained easily, speedily and at a negligible cost and which is capable of producing copies at a high rate comparable with those of present-day office copiers of both the dry and wet types.

It is another object of the invention to provide a system of the character described using a machine which can be produced for the market at a cost considerably lower than the costs of present-day wet and dry machines.

It is another object of the invention to provide a system of the character described for which the toner can be particularly inexpensive.

It is another object of the invention to provide a system of the character described in which the copy can be made of any color that the user wishes.

It is another object of the invention to provide a system of the character described in which the copy is not smeary or smudgy, does not offset, has no tendency toward trailing, and has a clean edge definition and good fill.

It is another object of the invention to provide a system of the character described which, in general, is not subject to the drawbacks of existing office copiers of the electrostatic type.

It is another object of the invention to provide a system of the character described in which the copy can be made as quick-setting as desired and which does not require extensive drying of the liquid in the developer inasmuch as the copy has far less of the liquid developer applied to it than in a conventional liquid copier.

It is another object of the invention to provide a system of the character described in which the liquid component of the liquid developer can either be polar or non-polar, or aqueous or non-aqueous.

It is another object of the invention to provide a system of the character described which can employ any type of surface carrying a charge image and which is capable of using the sophisticated variations heretofore proposed for liquid developing systems concerning the setting of a developed image on an original charge-image-carrying surface or the transfer of such developed image from such a surface to a paper-type surface.

It is another object of the invention to provide a system of the character described which is not based on the system of selective wetting, or on a system of passing an entire surface with an electrostatic image thereon through a liquid bath or held in contact, even momentarily, with a developing liquid.

It is another object of the invention to provide a system of the character described which employs a totally unique method of transferring developer liquid from a member to an object spaced therefrom under the control of an electric field image, the developer liquid assuming, during transfer, a configuration constituting a multitude of closely spaced tiny amorphous (individually non-image-defining) pseudopods which are, in the main, directed toward segments of the object to be imaged so that the background area remains essentially untouched by the developer liquid.

It is another object of the invention to provide a system of the character described which in one form employs a developer liquid in which fine particles are uniformly dispersed throughout the liquid and, more particularly, in which the concentration of fine particles employed during the development process is much greater than heretofore has been utilized so that the density of the image will be satisfactory despite the fact that the quantity of liquid contacting the surface of the object is far less than heretofore has been used.

Other objects of the invention in part will be obvious and in part will be pointed out hereinafter.

Brief Description of the Invention

The system of the present invention relates solely to the development of an electric field image. The development takes place on a carrier. In the preferred form of the invention the electric field image constitutes an electrostatic image. However, as will be apparent subsequently, the electric field can be created in other ways, a typical mode being the use of selectively charged styli which usually will be immediately in back of the surface of the object on which the developed image is to be deposited. The invention is not concerned with the manner in which this electric field image is created or maintained. Said electric field image can either be a positive image or a negative image. For example, if the latent image is an electrostatic image, it may constitute electrostatically charged areas juxtaposed to uncharged areas, the charged areas constituting the electrostatic image which is to be developed by depositing a colored liquid thereon. Alternatively, the image to be developed may be the uncharged areas, in which case it will be the charged areas that remain uncolored. The carrier on which the developer is to be deposited can be liquid-repellent or liquid-wettable.

In the event that the electrostatic image is created by a process which includes the casting of a modulated electromagnetic energy beam thereon, the surface of the carrier is photoconductive. For example, it may be zinc oxide in a polyvinylacetate matrix coated on a paper sheet which currently is the most widely used commercially employed photoconductively coated sheet. Another type of surface is a selenium surface which usually will be a rigid surface in the form of a drum. Another material currently employed for the same purpose is polyvinylcarbazole, appropriately sensitized, which is a polymeric photoconductor. Another type of object that can be employed for presenting electrostatic images to a developer liquid is a dielectric sheet, for instance, a sheet of polyvinylacetate or of aluminized Mylar. The carrier may be flexible as it is when it is in the form of a sheet, or it may be rigid as it is when it is in the form of a drum.

An electric field charge in the shape of an image can be imparted to the dielectric sheet as by electrostatic transfer, or as by the selective energization of styli placed behind the sheet during the moment of developer transfer, or as by imposing an electrostatic charge on the sheet by the use of styli prior to development and located either in back of or at the front of the sheet with such appropriate conductive backing plates or segments as are necessary, the styli being momentarily pulsed to create the charge image on the sheet.

The liquid developer has a surface located at a specific site, to wit, the development zone. A preferred arrangement is the provision of the liquid developer in a tray with a cylindrical developer roller turning about a horizontal axis and having a portion submerged in the tray, the roller being rotated so that portions thereof successively contact the liquid developer in the tray and thereafter are transferred on the surface of the roller toward the carrier on which the electric field image is disposed. The roller may be smooth, in which event liquid developer is present on the surface of the roller in the form of a thin film and enters the development zone in that form. Such film preferably is about 1.5 mils thick.

Alternatively, the roller may be textured. The texturing is of any form known to the art, e.g. annular groove, helical grooves, a pattern of depressions, i.e. an arrangement in which the surface of the liquid is interrupted but in which the liquid is a single body with all parts interconnected, or it may be a gravure pattern in which the liquid constitutes a multiplicity of tiny cells which, in the main, are discrete, i.e. not connected to one another.

The developer may also be supplied by capillary means, that is to say, there may be a body of developer liquid which is in contact with a capillary transfer arrangement which transfers the developer from the body of liquid to a site adjacent the object having the electric field image.

In all of the various arrangements for supplying the developer to a development zone, the location of the developer with respect to the object on which a developed image is to be formed is not critical with respect to whether the surface on which the developed image is to be formed is above or below the developer that is to be transferred to the surface. In a preferred form, said surface of the developer is below the surface on which the developed image is to be formed. It is within the scope of the invention, however, to reverse this situation and have the surface of the developer above the surface on which the image is to be formed, or, indeed, to have the developer and the surface on which the image is to be formed lie in a common horizontal plane.

The keystone of the present invention, that is to say, the single critical distinguishing factor thereof, is the mode of transfer of the liquid developer from its supply, e.g. body, to the object on which the developed image is formed and with which the electric field image is associated. The surface of the developer, in accordance with this invention, must be spaced at the development zone from the surface of the object on which the image is to be formed and, moreover, the developer must assume a certain special and unique physical configuration at or upon approach to the development zone as the transfer of the developer to the object on which the developer is to be placed is effected. The developer is presented to the object on which development is to be effected at or approaching the development zone in a physical form which is such that the developer there provides a surface of a liquid which is close to but out of contact with the aforesaid object and is in the presence of an imagewise electric field which, as noted previously, may be created by a latent electrostatic image or by some external means for engendering this field. Said field is in the configuration of the image to be formed by development. The field exerts a unique effect on the surface of the liquid. It causes the liquid at the development zone to assume the shape of a multiplicity of closely spaced tiny amorphous pseudopoidal protuberances, hereinafter referred to as "pseudopods", which extend from the original surface of the liquid toward an object on which the developed image is to be formed. The term "amorphous" denotes that the configuration of individual pseudopods does not conform to the shape of the image being developed. Conjointly, the pseudopods define said image.

Depending upon various parameters which may include the density of the liquid, the electrical conductivity of the liquid, the viscosity of the liquid, the surface tension of the liquid and the physical characteristics of the structure on which the liquid is supported, any one of various things will happen to the pseudopods, the particular event not being crucial to the functioning of the invention. Thus, the tip of a pseudopod may contact the surface on which the developed image is to be formed and a small body of liquid, i.e. a drop of liquid, at the tip of the pseudopod will be deposited on said surface of the object and, thereafter, as the liquid moves away from the surface of the object, this drop will become detached from the balance of the liquid in the pseudopod and the balance of the liquid in the pseudopod will collapse. Or the liquid at the tip of the pseudopod may, under the electric field force prevailing and before the tip of the pseudopod contacts the surface to be developed, be formed into a drop of developer liquid, which becomes detached from the balance of the liquid in the paeudopod and flies toward and impinges upon the surface on which the image is to be developed. Or, particularly if the surface on which the developer liquid is provided is in the form of a gravure surface supplying disconnected tiny bodies of liquid, the bodies may be small enough to rise up under the influence of the electric field in the shape of pseudopods each of which constitutes the entire body of liquid and which upon impingement on a surface bearing a latent image, together with surrounding pseudopods, provides a group of closely spaced dots that constitute a developed image. As indicated previously, in actual practice the transfer of the liquid may be a combination of any two or more of the foregoing procedures.

The pseudopod phenomenon has been observed visually. It is believed, moreover, that a subordinate phenomenon also may take place, namely, the formation of jets which actually constitute a form of pseudopod and which may emanate from the tips of the pseudopods being directed toward the surface to be developed. The jets have not been observed visually and have been mentioned here simply to indicate that the creation and use of the same in the development steps lies within the ambit of the instant invention.

The formation of the pseudopods varies somewhat, depending upon the nature of the body of liquid from which they rise under the influence of the imagewise electric field. Thus, if the body of liquid from which pseudopods are drawn is relatively large in comparison with the volume of the pseudopod, what usually will occur is that the body of the liquid rises toward the object on which an image is to be formed as a mound and, as the mound approaches closer to the object, the center of the mound rises higher and higher until it assumes the shape of a pseudopod. The liquid in the mound and in the pseudopod is drawn from the body of the liquid developer, and this phenomenon does not noticeably occur where the body of liquid from which the pseudopod is drawn is of a smaller volume such, for instance, as where the liquid is contained in small cells in a gravure surface.

The pseudopods are created where the electric field image is present, for example, where the electric field creates a force which forms and raises the pseudopod. Where the field does not exist or is of a considerably lower order of magnitude, either no pseudopods will be raised or any pseudopods which may be created, for example near the boundary of the electric field, are not high enough for the liquid at the tips thereof to reach the surface on which the image is to be formed. Therefore, the liquid developer does not, in general, impinge upon what may be referred to as the background area whereby this area remains untouched, in other words, virgin. Hence, the background area remains in its original condition, specifically in its original color.

This characteristic of the present invention distinguishes it markedly from prior art developing techniques, specifically those techniques in which liquid developer contacted an entire surface of an object on which an image was to be created. In such prior art systems the creation of an image with the assistance of a liquid developer principally relied upon the phenomenon of electrophoresis in accordance with which particulate matter in the developer migrated under the influence of the electric field to preferentially deposit in the shape of the charged image. Nevertheless, because the entire surface was contacted by the liquid developer, inevitably some particles in the liquid developer would adhere to the surface, even in background areas, so that the background area no longer retained its virgin coloration. Moreover, the presence of stray electric fields could not be avoided, and these fields would create small developed areas appearing, for example, as unwanted spots, blotches or lines in background areas which distorted the developed image and also lowered the contrast thereof.

Where the pseudopods are formed on a surface which is below the surface of the object that is to be developed, an additional factor aids in maintaining the background virgin. This is the employment of gravitational force which opposes the raising of the pseudopods, and particularly the touching of the liquid at or from the tip of the pseudopod with the surface of the object that is to have the developed image emplaced thereon. A further factor also assists in maintaining the background surface in virgin condition, namely, the surface tension of the developer liquid which likewise tends to pull the pseudopods back to the original condition of the developer liquid.

The formation of pseudopods, in accordance with the present invention, is believed to be due to minute irregularities in the surface of the developer liquid at or approaching the development zone, and/or to minute irregularities in the electric field thereat. This combination of irregularities creates variations in the forces applied to any particular tiny area in the surface of the liquid developer at or approaching the development zone. Thus, if such a tiny area is somewhat closer to the object to be developed and/or if the electric field to which this tiny area is subjected to slightly stronger, the surface of liquid starts to rise to a small degree and, as it rises, the electric force increases due to the smaller distance between said area and the surface of the object on which the developer is to be deposited. This action avalanches and very rapidly creates a pseudopod with the results described previously.

It will be appreciated that, since the pseudopods are created by an electric field, their rise, i.e. formation, en masse, is localized, i.e. restricted to a configuration of conjoint closely spaced pseudopods which mutually define the image to be formed. This is not to say that an entire image is fashioned at one time. What frequently occurs is that an image is formed in successive segments. The liquid developer and the object having the electric field image associated therewith first approach each other, then reach a point of closest proximity, and then diverge from each other. The formation of the closely spaced pseudopods initiates as the liquid developer approaches the surface of the object having the associated electric field image and, finally, the transfer, if there is one, by a multiplicity of closely spaced pseudopods takes place. Successive segments of an image to be developed sweep to and past the point of closest proximity and result in the desired development.

The pseudopods thus deposit the developer within the areas of segments of the image where the developer will form tiny closely spaced drops of deposited liquid. Depending upon the electric field and the nature of the surface of the object associated with said field, these drops may blend with one another or merge into one another. For example, if a surface is wettable by the developer, the drops of liquid will spread slightly. If the surface, moreover, is somewhat absorbent, the liquid of the drops will spread in the surface to blend into one another. If the surface is not wetted by the liquid, the drops will tend to bead. Where the surface is impervious, the liquid image is transferred from such a surface to a final copy sheet where the drops likewise may blend or merge to form the finished image.

Depending on the specific nature of the electric field image, various ancillary phenomena may occur.

Upon occasion, due to merging and augmentation of different segments of electric fields and to untoward vibrations in the liquid developer at the development zone, stray pseudopods may be raised and liquid therefrom contact the surface of the object associated with the electric field image. This is not sufficiently frequent to be a serious drawback. Moreover, it is believed that the liquid thus deposited, particularly where the object has a non-wetting liquid-impervious surface, is shifted under the influence of the electric fields to within the boundary of the electric field image itself, i.e. a drop of deposited liquid will tend to move from a position where the field is weak to a position where the field is stronger.

In a preferred form of the invention in which a developer roller is used, a photoconductive surface moves past and over this roller, itself being either held against a superior roller or being guided by a platen to travel in a horizontal path above the developer roller.

From the foregoing, it will be seen that it is a critical feature of the present invention that there be a gap, that is to say, a gas-filled space, between the surface of the liquid at or approaching the development zone and the surface of the object having associated therewith the electric field image, e.g. the surface of the photoconductor. The gap must be seen that it will enable pseudopods to be raised at this zone by the electric field image. The gap must be present in order to maintain virtually unsullied the integrity of the original virgin surface on which the image is to be developed. It was believed at the time parent application Ser. No. 676,463 and applications Ser. Nos. 916,041 and 916,042 were filed that this spacing should not be less than 4.5 mils, but it was not realized that the selection of such minimum dimension was influenced by the tolerances associated with the mechanical parts of the equipment with which the present system was being practiced. However, in some experiments, the significance of which were not fully understood at the time said prior applications were filed, the system of the instant invention has achieved successful results with a considerably smaller gap space than 4.5 mils, namely, as low as 1 mil. The important feature now is seen to reside not in a minimum spacing of 4.5 mils, but, rather, in the provision of a space in which pseudopods are raised under the influence of an electric field image, in the manner described above, in the image area. The spacing that is employed must be carefully controlled, inasmuch as if the spacing varies at the development zone the raising of the pseudopods will not be controlled essentially solely by the electric field image but by variations in the spacing which, quite apparently, will seriously deteriorate the image. However, as now is appreciated, if the spacing is precisely controlled, a satisfactory image can be obtained with a very small gap, namely, as little as 1 mil. Desirably, variation in spacing should be very slight, particularly at the small spacing of as low as 1 mil.

One machine approach to good control of the spacing is to have the surface on which the image is to be formed in the configuration of a surface of revolution such, for instance, as a cylinder, and to have the liquid developer supplied on a surface of revolution having a matching generatix, for example, another cylinder. The spacing between the cylinders at the development zone can be closely controlled by having annular ridges on either cylinder riding on the surface of the opposed cylinder. Where the surface on which the image is to be developed is electrically insulated and carries on electric field image, care must be exerted, where one roller rides on the other, to maintain them electrically separate. This can be accomplished as by having the annular ridges composed of electrically insulating material.

As a practical consideration, the maximum spacing for the gap is about 40 mils, although the preferred upper limit is 15 mils.

Where the developer roller has a gravure surface, i.e. a surface with discrete cells, each holding about enough liquid for the formation of one pseudopod, the gap spacing is about 2 mils from the surface of the roller at the tops of the cells to the surface with which the electric field image is associated. In this form of the invention the cells preferably are substantially completely filled with liquid developer as they approach the development zone. This most conveniently is accomplished by having the developer roller pass, during a portion of its travel, through a body of liquid developer and, after the submerged portion is raised above the surface of the liquid developer, substantially removing excess developer so that each cell is substantially full and a film of insignificant thickness remains on the roller above the cells. Such action may be accomplished with a doctor means, e.g. a blade.

It has been found that development is aided by the presence, which is not absolutely essential, of an externally applied electric field at the development zone which functions satisfactorily where the direction of the applied field preferably is the same as that of the field engendered by the electrostatic image so as to assist the same. The direction of the externally applied electric field depends upon whether the image to be developed is a negative or a positive image, and depends upon whether the charge polarity of the image is positive or negative. Typical voltages for the externally applied electric field vary from about −1,000 volts to about +1,000 volts, preferred values being considerably less, and excellent results being obtained at a value of about 150 volts. When the gap spacing increases, it is desirable to increase the aforesaid voltage, a typical voltage at a spacing of 15 mils being about 300 volts. It has been found, in general, that better images are secured with a smaller spacing than 15 mils but, of course, not smaller than 1 mil. The magnitude of the preferred applied electric field generally depends on the nature of the surface of the developer roller, the gap spacing and all of the variables of the liquid used. For example, 300 volts at a 4 mil gap spacing has been used satisfactorily in a specific configuration with a watery aqueous liquid developer and a smooth-surfaced developer roller.

The reason that a minimum spacing is critical to the operation of this invention is the aforesaid manner of operation of the present system which prevents the formation of background at the development zone that is characteristic of previous electrostatic liquid developer systems.

Although the developer in the preferred form of the invention includes solid particles suspended in a liquid, either aqueous or non-aqueous, the invention also functions, although not as satisfactorily for many purposes, where coloration is imparted to the liquid developer and ultimately to the developed image by a color agent, e.g. a dye, dissolved in the liquid carrier.

The primary utilization of the instant invention is the creation of a visually observable developed image. Nevertheless, the invention has other uses. For example, if the developed image is to be used as a lithographic master or generally as a printing member, the developed image does not have to be visually observable. All that is necessary, in that event, is that the developed image have a surface which is different in some physical characteristic, other than visibility, from the surface of the background. For example, the developed image may be lipophilic, in which case the background area would be hydrophilic, or vice versa.

The invention also embraces the use of a developer which, instead of imparting coloration or other change in material physical characteristics to the surface by the use of a dye or pigment, chemically reacts with the surface on which the image is to be formed, the chemical reaction resulting either in the impartation of a selective visual color change which distinguishes the developed image from the background area, or in a change which alters the physical characteristics of the surface on which the developer is deposited, for example, renders the surface lipophilic, in contrast to an original hydropholic surface.

The invention consists in the features of construction, combinations of elements, arrangements of parts, compositions and series of steps which will be exemplified in the methods, apparatuses and compositions hereinafter described and of which the scope of application will be indicated in the appended claims.

BRIEF DESCRIPTION OF THE DRAWINGS

In the accompanying drawings in which are shown various possible embodiments of the invention:

FIG. 1 is a schematic diagram of an apparatus for carrying out the present invention in which the developer roller is a cylinder with an uninterrupted cylindrical surface and in which the electric field image constitutes an electrostatic image on a web the surface of which that faces the developer roller carries a photoconductive coating;

FIGS. 2 through 9 are highly enlarged views of the development zone of the apparatus of FIG. 1, showing progressive stages leading to and following pseudopod development of a single charged area of an electrostatic image on a photoconductive surface;

FIG. 11 is a view similar to FIG. 8, but illustrating plural, widely spaced charged areas of an electrostatic image on the photoconductive surface and also illustrating a voltage on the developer roller;

FIG. 12 is a view similar to FIG. 8, but illustrating in the background a second pseudopod for a charged area of an electrostatic image on the photoconductive surface which is about to be developed;

FIG. 13 is a view similar to FIG. 7, but showing twin pseudopods associated with two discrete charged areas of an electrostatic image on the photoconductive surface;

FIG. 14 is a view similar to FIG. 8, but showing a non-wetting photoconductive surface in contrast to the wetting photoconductive surface of FIG. 8;

FIG. 15 is a view similar to FIG. 9, but illustrating a deposited droplet on the photoconductive surface which latter is of a non-wettable nature as distinguished from the wettable nature of the photoconductive surface in FIG. 9;

FIG. 16 is a view similar to FIG. 8, but showing the detachment of a droplet from the pseudopod, the same being illustrated at a stage when the droplet has become detached from the tip of the pseudopod and is moving toward but has not yet reached the photoconductive surface, and differing from FIG. 8 in that in FIG. 8 the tip of the pseudopod has touched the photoconductive surface;

FIG. 17 is a perspective view of an apparatus embodying an alternate form of the invention in which at the development zone in the liquid developer is raised by a capillary passageway that leads from a body of liquid developer to a region spaced from and below a photoconductive surface, the latter not being shown in said figure;

FIG. 40 is a view similar to FIG. 1 of another embodiment of the invention in which the developer roller is angularly spaced from the bottom of the platen on which the photocondutor web is trained.

DESCRIPTION OF THE PREFERRED EMBODIMENTS

Figure 6:
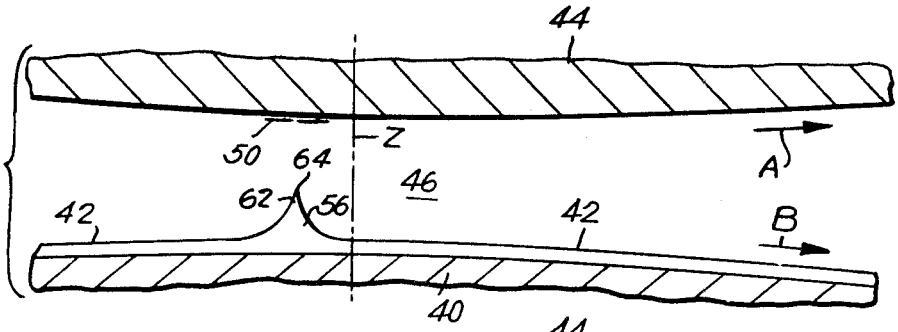

Referring now in detail to the drawings, and more particularly to FIGS. 1 through 9, the reference numeral 20 denotes one embodiment of an apparatus for carrying out the instant invention. In all respects, except development, said apparatus is conventional.

The apparatus includes a back-up platen 22 of cylindrical configuration and suitable means to rotate the same about a horizontal axis; this means is not illustrated, being conventional. The principal function of the back-up platen is to define a path of travel for a web 24 from a supply roll 26 past a charging station 28 and an exposure station 30 to a development station 32, and thereafter for the developed web as it is led to a drying station 33 and, finally, to a take-up roll 34.

The charging station is conventional. It constitutes a corona charging station. The exposure station 30 likewise is conventional and includes, as is well known, a source of radiant energy which projects a beam of such energy either through a transparency to be reproduced, or reflects such a beam off an opaque carrier on which there is provided an image to be reproduced, the beam of radiant energy thereby being modulated by the image to be reproduced. The modulated beam then is directed onto the charged web 24 to form an electrostatic image thereon in a manner with which the art is thoroughly familiar.

At the development station web has the latent image developed at a development zone Z (see FIGS. 2–9). The development station includes a tray 36 containing a body of liquid developer 38. A developer roller 40 having a horizontal axis of rotation parallel to that of the platen is turned by a suitable power source (not shown), the roller being so located that the lower side thereof is submerged in the liquid developer whereby the turning roller pulls up from the tray 36 a film 42 of liquid developer on the roller surface to and then past the development zone Z.

It is desirable to obtain a constant thickness of film and, for this purpose, the roller 40 is shown as being provided with a doctoring means 43 in the form of a stationary doctor blade which extends parallel to the axis of rotation of the roller and has a linear edge disposed a controllable fixed distance therefrom.

The web 24 is of conventional construction for a copy sheet. It includes a carrier substrate, e.g. paper, having a photoconductive coating 44 on one surface. This coating faces away from the platen 22. Since in the apparatus 20 the developer roller 40 is vertically below the axis of rotation of the platen, the photoconductor surface faces downwardly toward the developer roller at the development zone Z.

At the charging station 28 an electrostatic charge, e.g. a negative charge, is applied to the photoconductive coating 44, the charge being uniform over the coating as it leaves the charging station.

At the exposure station 30 the impingement of the modulated beam of radiant energy causes a discharge of the electrostatic charge on the surface of the photoconductive coating at those segments where radiant energy strikes said surface. The remainder of the electrostatic charge remains in the form of an electrostatic image not visible to the eye. This is the image which is to be developed at the development station 32.

It is well to mention at this point that a typical photoconductive surface constitutes a coating on a carrier, e.g. a paper carrier, having a conductive rear surface, the coating being, for example, zinc oxide in a matrix of polyvinylacetate. Such a photoconductive coated carrier is widely used in office copying machines at the present time and is a standard item of commerce. The photoconductive surface, instead of being part of a continuous web 24 as illustrated, may constitute pre-cut sheets, in which event, the sheets will be guided and driven over a stationary curved platen surface past the charging, exposure and development stations, in turn, or may be passed over or by a flat platen as it moves from the first of these stations to and past the succeeding ones.

FIG. 1 simply is representative of one of the many types of wet standard office copier apparatuses, any of which can be substituted for the one illustrated, wherein the only difference and novelty resides in the development station, this having been described in general terms heretofore.

When a continuous web is employed, as shown, and leaves the apparatus to be stored on a take-up roll, subsequently the web, with developed images, is drawn off the take-up roll and subdivided into sheets each including one or more of the developed images. If desired, the take-up roll can be omitted and a standard cutting mechanism utilized to cut one sheet at a time from the terminal end of the web after development, each such sheet including, usually, only a single developed image.

These alternate forms of the apparatus have been mentioned in passing so that it will be understood that the instant invention is not to be restricted to any particular form of apparatus, with the sole exception of the novel principle that is employed at the development station.

The specific structure of the development station can be varied and, indeed, sundry alternate structures have been illustrated in figures which will be described subsequently, and alternate locations for the development station 32 have been illustrated in various figures.

The charging and exposure stations illustrated likewise are only exemplificative. Various other modes well known to the art can be utilized to impart an electrostatic image of any desired configuration to the outwardly facing surface of a carrier. Thus, the electrostatic image can be employed on a dielectric carrier by transference from a previously charged photoconductive surface; or an electrostatic image can be emplaced on a dielectric surface by alternate means such as by electrically charged pins; or by an electrostatically charged face of a cathode ray tube; or by a scribing implement such as an electrically charged stylus which can be used to write on the surface; or by an electrically charged element in the configuration of an image of the desired shape; or by a thin beam of electrically charged particles, e.g. electrons, which is directed as by electrostatic and/or electromagnetic yokes to follow a desired path; or by charging with a broad area charging beam through a mask in the desired pattern.

In addition, it is pointed out that the present invention is not restricted to the specific photoconductive coating hereinabove mentioned in the description of the aforementioned embodiment, to wit, zinc oxide in a polyvinylacetate matrix. For example, the photoconductive surface may be formed of selenium, e.g. as the surface of an electrically conductive drum which successively passes charging, exposure and development stations and thereafter a transfer station for transferring the developed image, still in liquid form, as will be apparent subsequently, to a copy sheet such as a plain (uncoated) paper sheet.

Still another form of charge image carrier is a dielectric sheet with a conductive coating on its reverse side, as, for example, aluminized Mylar, or which may be uncoated, but, in that event, preferably is in proximity to an electrically conductive member such as a platen at the time of charging. Such sheets may have an electrostatic charge in the configuration of a latent image emplaced thereon by any one of the modes heretofore described except that of corona charging and subsequent radiant energy selective discharging.

Summarizing, the development which constitute the heart of the present invention is a novel method of creating a material physical image on a surface of an object, this image creation hereinafter frequently being referred to as "developing" or "toning", and the same being effected with the assistance of an electric field image, such term "electric field image" embracing both an electrical field image that is formed by external means and is evanescent in character as describe later herein, or an electric field image which is associated with an electrostatic image. The development of the present invention does not embrace that part of the system pursuant to which the electric field image is created, nor the use that is made of the toned image. For convenience, in many portions of this description which follow, reference will be made to an electrostatic image or a latent image and, in almost all instances, except where the formation of an electrostatic image is specifically described, the terms "latent image" and "electrostatic image" are generic to all manners of electric field image, both those formed by an external electric field and those accompanying an electrostatic image.

An electrostatic image may be formed in many ways, all of which fall under one or the other of two generic classes. In the first class, a substrate is uniformly electrically charged over its entire surface and subsequently is selectively discharged according to a predetermined pattern; in the other class a substrate has a patterned electrical charge applied to it without first uniformly charging a broad area that subsequently is discharged to leave a pattern.

In the first mentioned class, the mode of broad area charging is not critical; it has no bearing upon the toning step of the instant invention. Various methods of charging can be utilized. One is the use of a corona charging device. Another is transfer charging as from a charged platen or a roller. In all of these broad area charging methods the substrate is such that it will hold the broad area charge and can be discharged selectively in the time frame required to tone the image.

The ways in which selective discharge may be effected are many. By way of example, one is to employ a photoconductive surface such as mentioned above and to discharge the same selectively in a pattern by casting thereon a broad beam of imagewise modulated electromagnetic energy to discharge selected segments of the broad area and leave the remnant desired charge pattern. Such a beam of electromagnetic energy can be a beam of light, or it may be a beam of electromagnetic energy of a different frequency than light, this being, for instance, an imagewise modulated X-ray beam or an imagewise modulated ultraviolet beam. The imagewise modulated broad area beam is cast on the charged surface of the substrate either directly, or by reflection, or by transmission through the substrate from an opposite surface thereof, the substrate in such case being transparent to the energy used.

In all of the just mentioned systems, the substrate is characterized by its ability selectively to discharge a surface charge upon the impingement thereon or therethrough of a beam of electromagnetic energy.

Also embraced within the first call are systems wherein the substrate is not such as to be discharged by the impingement of an imagewise modulated broad area electromagnetic energy beam, for example, being not photoconductive but simply dielectric. A broad area charged dielectric substrate can be discharged by directing a beam thereon that is image-wise modulated over a broad area and is capable of selectively discharging the broad area charge or neutralizing the same. Such a beam, for example, can be a broad area ion beam.

Equipment for broad area patterned neutralization or discharge of a charged substrate is of sundry types. In one the imagewise modulated beam and charged substrate move in synchronism; in another the imagewise modulated beam is of extremely short duration and high intensity, e.g. a flash.

Furthermore, in the first class, neutralization or discharge of a broad area charged substrate may be accomplished by contacting the broad area charged surface with a narrow element which selectively discharges segments thereof according to a desired pattern. This narrow element can be a mechanical member, for instance, a grounding rod, or it may merely be a narrow beam which can cause the charge to be differentially neutralized or discharged and leave a predetermined charge pattern. For instance, the beam may be a narrow beam of light which is scanned over the broad area and modulated as it is scanned so as to selectively discharge or neutralize successive segments, the scanning being of the raster type.

Instead of employing a light beam, a beam of electromagnetic energy of a frequency different from light frequency can be used, or, if desired, the scanning can be accomplished with a beam of coherent electromagnetic energy such as a laser beam. Such a scanning beam can be controlled, for instance, by a computer which modulates the beam as it scans. Devices of this nature can be used to perform what has been commonly referred to as computer printing and are employed, for instance, in composing images suitable for use in the printing of newspapers or, in general, in the graphic arts.

The narrow beam type of neutralizing or discharging a broad area charge can be applied to substrates of the simple dielectric type as well as to substrates which are discharged by the impingement thereon or therethrough of narrow beams of electromagnetic energy.

The other class of creating charge patterns is practiced with a dielectric substrate which is capable of having emplaced thereon a charge that will remain in position long enough to be tone developed and which will retain its integrity on the substrate. Such a substrate has an electrostatic image impressed thereon in a manner similar to any of the modes mentioned earlier in connection with selective discharge, e.g. latent electrically charged pins, the electrostatically charged face of a cathode ray tube, etc. These include, by way of summation, the emplacement of an entire charge image at one time or the emplacement of an image by movement of a narrow beam of charged particles across the surface to be image charged.

The electrostatic image discussed in the preceding paragraph is a semi-permanent image in the sense that when impressed on a carrier it remains in position creating an associated electric field image, unless deliberately erased, at least until such time as the image is developed by application of a liquid developer thereto in the manner described heretofore and hereafter.

An electric field can be created externally without the presence of an electrostatic image. Preferably, such a field will be evanescent in character, being present only long enough for the same to be used to form a developed image. For example, and as described hereinafter in greater detail, means may be included at the development zone, for instance in back of the object, which is, for example, a sheet or web, on which the developed image is to be formed, a myriad number of fine styli in rather closely spaced relationship, the styli having associated therewith circuit means for pulsing selected styli as desired to conjointly define one or more characters or configurations which are designed to be developed on the object. At some given instant, selected styli will have a voltage imparted thereto and, at the same time, the object in front of the styli will be located at the development zone. The thus-energized styli momentarily will create an electric field image which will cause pseudopods to be raised in the manner described heretofore and hereafter and thus form a developed image.

The pulsing means to create the electric field images externally rather than with electrostatic charges is stationary behind the moving carrier at the development zone and is activated when the proper portion of the carrier is in position to accept desired developed images.

It will be understood, of course, that, in accordance with the present invention, the creation of electric field images is achieved by the use of electric circuitry, styli configuration, choice of appropriate materials for the carrier on which the image is to be deposited, and structure and arrangement of the developer roller or its equivalent, will of such mutual natures as to enable the creation of an electric field of suitable strength to raise the requisite pseudopods.

The carrier preferably moves to and past the development zone and preferably moves in a path which comes nearer to and then further from the surface of the developer liquid at the development zone. The formation of the pseudopods may take place at the point of closest approach of the carrier to the developer liquid, or, more usually, in the case of electrostatic images, the pseudopods may be formed and the developer liquid thus transported before the point of closest approach of the carrier (object) to the surface of the developer liquid.

As has been pointed out, the principal novel critical feature of the present invention is a gap at the liquid development zone between the surface of the liquid developer as presented at said zone and the surface of the object with which an electric field image is associated and, in conjunction therewith, the mode of transfer, i.e. by closely spaced tiny amorphous pseudopods in the joint configuration of an image, of the liquid developer that transports said liquid across this gap. The reasons for the presence of the gap and the function of the gap have been detailed heretofore in connection with the "Brief Description of the Invention".

The aforesaid gap can be seen upon close inspection of FIG. 1 where the gap has been shown to disproportionately large scale with respect to the other components of this figure in order that its presence may be readily apparent. Despite this distortion of the figure, the gap really is not illustrated well enough to fully comprehend its function and, therefore, the development zone Z and its adjacent regions, both before and after said zone, are shown to a highly enlarged scale in FIGS. 2–9. In these figures the photoconductive coating 44 and the developer roller 40 with its film 42 of liquid developer are greatly enlarged, as is the gap 46 at the development zone Z. None of these components is shown strictly to scale, even as to relative sizes.

Both the photoconductor coating 44, by virtue of its presence on the sheet and the support of the sheet on the cylindrical plating, and the developer roller 40 portions of which are shown in FIGS. 2–9, are cylindrical. Both of these may be of the same radius. However, as illustrated in FIG. 1, the platen 22 and, hence, the photoconductive coating 44 have greater radii than the developer roller 40. Nevertheless, for convenience, in FIGS. 2–9 the photoconductive coating 44, the developer roller 40 and the film 42 of liquid developer have been illustrated as having substantially the same radii.

As illustrated in FIGS. 1–9, the platen 22 turns in a counterclockwise direction indicated by the arrow A, and the developer roller 40 turns in a clockwise direction indicated by the arrow B, so that at the development zone Z both the platen and developer roller have surfaces traveling in substantially the same direction and approaching each other. Actually, the directions are not identical except precisely at the development zone, inasmuch as the directions of travel A and B are circular rather than linear, so that as the photoconductive coating 44 and the film 42 of liquid developer approach the development zone Z they come closer to each other, and as they leave the development zone Z they diverge from each other.

Save for electrostatically and mechanically engendered disturbances in the film 42 at the development station, said film, as it is pulled up from the tray 38, maintains a substantially constant thickness. The range of thicknesses of the film 42 of liquid developer can be controlled to vary from about ½ mil to about 10 mils, and preferably is about 1.5 mils.

The surface speeds of the photoconductive coating and the liquid film at the development zone can vary quite widely. Even a speed of 400 feet per minute is well within the scope of the present invention.

Preferably, the directions of surface travel of the photoconductive coating and of the film of liquid developer are the same at the development zone. The absolute speeds likewise may be the same or they may vary somewhat. Relative speeds of the photoconductor surface and the film of liquid developer at the development zone have been found to be operable pursuant to the present invention where the speeds are identical or where they vary as much as 20 feet per minute from each other. A preferable relative speed is one in which the photoconductive coating travels to and past the development zone from about one foot per minute faster to about one foot per minute slower than does the film of liquid developer. Preferred speeds for the photoconductive coating range from about 20 feet per minute to about 150 feet per minute.

With regard to the critical range of spacing of the gap 46, the smallest gap from the photoconductive surface 44 to the surface of the liquid film 42 in substantially unchanging state at the development zone Z is about 1 mil. With a lesser spacing, and even with the most favorable values of the sundry variables discussed heretofore and hereinafter, the desirably clean background of the developed image will have deposits of liquid developer thereon. These may be enough to render the developed image completely illegible, or merely destroy the clarity of the image as by losing edge definition. At a spacing of at least about 1 mil with proper adjustments of all parameters, a commercially acceptable image can be obtained through the use of the present invention.

The minimum gap spacing that has been discussed is difficult of realization in that it requires the use of close tolerances for mechanical components of the equipment. For example, the radial play in the bearings of the two rollers must be very small. The linearity of the generating surfaces of the two rollers must be highly precise. The deviation from circularity of all points on the surfaces of the two rollers must be minimal. Variations in the absolute dimensions of the parts may be cumulative, making it most difficult to realize a minimum gap spacing of 1 mil. For this reason it was considered at the time that applications Ser. Nos. 676,463, 916,041 and 916,042 were filed, and for a time subsequently, that the practical minimum gap spacing should be 4.5 mils. Further work has demonstrated that it is realistic to obtain a reproducible commercially acceptable apparatus in which a minimum gap spacing is consistently maintainable well below 4.5 mils. A gap spacing of 2 mils has been regularly maintained, and a gap spacing of even as small as 1 mil is within reach and functions efficiently pursuant to the instant invention. The mode of maintaining such a small gap spacing on a repoducible basis is either to maintain close tolerances in the bearings and the roller dimensions and configurations, or to have the gap spacing controlled by having either of the rollers roll on the other roller with spacing means interposed between them.

With aqueous toners, a preferred gap spacing is about 4.5 mils.

Mention has been made heretofore of the character of the surface of the developer roller. Briefly reviewing, this surface may be smooth, i.e. a continuous cylinder without any interruptions or surface irregularities, for instance, a polished cylinder. Alternately, the surface may be one with surface irregularities, preferably orderly irregularities rather than random irregularities. A desirable form of surface is one with identations, e.g. of the type known in the printing art as a "gravure" surface, this constituting a myriad of tiny depressions, i.e. pockets, each forming an individual open-mounted cell separated from all the other cells. A typical such gravure surface for use in the present invention is one where each cell has a depth of about 1 mil to about 3 mils and transverse dimensions in the order of about 4 to about 6 mils. The cells preferably are in an orderly pattern, e.g. orthogonally arranged. The surfaces between the cells are about 1 to about 2 mils in width. The surface irregularity also may take the shape of a herringbone pattern of grooves, or a cross-hatched pattern of grooves, or a thread, i.e. a spiral groove, or a multiple, i.e. intercalated, set of spiral grooves, or a series of parallel annular grooves. In these latter cases, that is, the structures mentioned after the gravure surface, the developer in the depressions (grooves) forms a network of interconnected bodies which conjointly act as a reservoir for supplying the liquid of the pseudopods, whereas in the gravure surface the liquid developer in each individual cell represents essentially the only source of liquid available for one or a few pseudopods that will rise from that cell. Another form of surface may be one which has been irregularly eroded as by random etching or by particle blasting.

The surface potential of the electrostatic image preferably is that which is commonly employed in the art for office copiers, whether of the dry or liquid type. A typical surface potential for the electrostatic image is not less than about 100 volts and usually will be in the vicinity of about 450 volts, either positive or negative. Such a surface potential is employed for coated paper, i.e. paper coated with zinc oxide in a polyvinylacetate carrier. A similar order of potential, e.g. in the range of about 600 to about 1,000 volts, is employed for photoconductive surfaces of selenium, polyvinylcarbazol and cadmium sulfide.

The aforesaid potentials usually are applied by corona charging equipment which leaves a residual electrostatic charge of the mentioned magnitudes; this does not apply to dielectric sheets. A transferred charge or charges applied through instrumentation such as writing beams or writing implements likewise will be of the same orders of magnitude.

To minimize variations in the gap uniformity where the photoconductive surface is on a flexible sheet such as a web of paper, it is desirable to make the platen 22 hollow and foraminous and to maintain a vacuum on the inner surface of the platen at the development station, this being accomplished by providing a vacuum box 48 inside the platen at said station. The vacuum will pull the web against the platen at the development station so that it occupies a substantially definite position during development, particularly at the development zone.

The liquid developer film thickness is maintained substantially constant at radially quiescent portions of the film as they approach the development zone, by maintaining a uniform speed of rotation of the developer roller, by protecting the development zone, e.g. with baffles, to inhibit moving air currents, and by constructing and supporting the machine to minimize vibration. This latter is not a noticeable factor nor, indeed, are the normal movements of air in the apparatus 20 wherein the various parts are housed in a casing (not shown) as much for the purpose of esthetics as for the purpose of keeping the sundry parts and developing liquid free of contamination.

Any ordinary motor and power drive will turn the developer roller and the platen at speeds which are substantially constant.

A great variety of developers may be used to carry out the present invention. The physical characteristics of such developers are characterized by certain attributes, for example, the developer must be liquid or readily liquefiable. Thus, if the developer is not a liquid, as supplied, it can be thixotropic and liquefied by the application of stress such as engendered by movement of an element in or touching the developer, or the developer may be normally solid but may be readily liquefiable by the application of a solvent or by the application of a mild degree of heat. The liquid or liquefied developer has a suitable surface tension, a suitable viscosity, a suitable density, a suitable electrical conductance and, for most applications, a suitable percentage of solid content, the solids being fully soluble, partially soluble or totally insoluble in the liquid carrier, and if the latter being particulate. The solids or liquid carrier are inert to or reactive with the substrate on which the physical material image is to be formed. The solids may form the developed image when the latter is dried, as by volatilization of the liquid carrier, or by curing of the liquid carrier or by absorption of the liquid carrier in the substrate.

A suitable range of viscosities for the liquid developer is from about 0.5 centipoises to about 2,000 centipoises. By way of example, a satisfactory liquid developer is one predominantly constituting water and including a slight amount of dyes, e.g. about 0.5% by weight of a dye or dyes, and has a viscosity of approximately 0.9 centipoises. Another satisfactory liquid toner is one which employs an organic solvent such, for instance, as Isopar H, and has present therein dissolved resins, dispersants and charging agents, the latter optionally being dispersed, and dispersed pigments; it usually has a viscosity in the range of about 20 to about 60 centipoises, as measured with a Brookfield Viscosimeter Model LVF using a No. 1 spindle rotating at 6 rpm.

Another suitable liquid developer is a latex paint of the common, everyday variety such as is obtained from paint stores and is used for painting the interior or exterior of a house and which may be a flat paint or an enamel. The viscosity of such a paint is in the order of 38 centipoises. The latex paints may be thixotropic and, if so, their viscosity will vary with the speed of the developer roller, variation in viscosity being typical as a function of agitation of thixotropic materials. The viscosities of such paints used in conjunction with the practice of this invention have varied with different roller speeds from about 2.5 to about 38 centipoises.

A suitable range of surface tensions for the liquid developer is from about 20 to about 75 dynes/cm. A preferred range of surface tensions is from about 20 to about 70 dynes/cm. The surface tension of water at 20° C., which essentially is the surface tension of dye-containing water developers, is about 72 dynes/cm. Water-based latex paints have a surface tension range of about 37 to about 41 dynes/cm. The surface tension of Isopar G, one of the organic solvents widely used in non-polar liquid developers, particularly for submersion development, is about 22 dynes/cm.

The density of the liquid developer has but little influence on the gap spacing. Generally speaking, liquids of higher densities will operate satisfactorily at lower gap spacings, all other parameters being about the same, and liquids of lower densities can operate at greater gap spacings, all other parameters being the same. Nevertheless, the parameters can be balanced to take into account the density of the liquid employed so that the same gap spacing can be used for liquids of different densities.

As mentioned previously, a preferred gap spacing for an aqueous developer containing a dye is about 4.5 mils. A smaller gap spacing, e.g. about 2 mils, is preferred for liquid developers such as paints or organic-base liquid developers using gravure surfaces. A suitable range of densities for the developer is from about 0.7 to about 1.60 g/cc.

A typical density for a paint-type latex water-base liquid developer is about 1 g/cc. A typical density for a liquid developer employing an Isopar organic liquid as the liquid carrier is about 0.85 g/cc.

With regard to electrical conductance, it has been observed that as the conductivity of the liquid developer is lower, the time required to raise pseudopods across the gap, all other conditions remaining the same, increases, and vice versa. This time becomes a significant factor only when the liquid developer roller is opposed to the electric field roller (e.g. the roller having associated electrostatic images) for a very brief period of time in a machine of about the size of a conventional table-top office copier. With such a machine, any of the developer liquids mentioned herein have an electrical conductivity that is acceptable. However, if the time during which these two elements are opposed to each other becomes very brief (at speeds commensurate with linear speeds of travel of the electric field roller and the developer roller of, say, 400 feet per minute), very low electrical conductivities may so retard the time required to raise the pseudopods as to make the system inoperable. A typical extreme of conductivity at the low end of the conductivity range is about $10^{-13}$ (ohm-cm)$^{-1}$. On the other hand, a different effect has been observed when the conductivity is too high. This causes a degradation of the image. The upper limit of conductivity is about $10^{-1}$ (ohm-cm)$^{-1}$. A preferred range of conductivity is from about $10^{13}$ (ohm-cm)$^{-1}$ to about $10^{-4}$ (ohm-cm)$^{-1}$. Conductivity in all cases is measured at 1 KHz. In general, the electrical conductivity employed for the liquid developer for any particular machine, although it can be within the ranges indicated, will depend upon the gap between the surface of the object with which the electric field image is associated and the surface of the liquid developer, the thickness of the liquid developer, the viscosity of the liquid developer, the surface tension of the liquid developer, the density of the liquid developer, the radii of the object, if cylindrical, and of the developer roller, the rates of rotation of the object and the developer roller, the surface configuration of the developer roller, and other factors that affect the resistance of the path through which the electric field travels.

Particularly where visible developed images are to be formed, it is desired to employ a high concentration of opaque solids-to-developer in the developer. This enables a readily visible image to be created. There are no particular criteria for the w/w concentration of opaque solids-to-developer inasmuch as this will be the function of the desired appearance of images formed on commercial machines. However, a typical w/w range is from about 0.1/100 to about 30/100. The extreme range is from about zero parts of opaque solids per 100 parts of developer to about 50 parts of opaque solids per 100 parts of developer.

The present invention will function with any liquid developer so long as the developer will, upon disappearance of the liquid carrier, e.g. by evaporation or curing, be impregnated into or deposited on the surface of the photoconductor or the surface of a copy sheet onto which a developed image, while still liquid, has been transferred from the photoconductor. For example, all of the current commercial liqud developers used in liquid office copier machines can function pursuant to the present invention.

The present invention will operate with polar and non-polar liquid carriers.

Other types of liquid carriers can be used, for example, an essentially non-volatile liquid such as a silicone oil or a mineral oil. The use of these latter types of liquids has the advantage that no appreciable amounts of carrier liquid escape into the air as vapor. Where non-volatile liquids are used such as just mentioned, it is desirable to employ a high weight ratio of solids to liquid inasmuch as substantially no liquid is lost by evaporation. The amount of liquid deposited upon development using an essentially non-volatile liquid carrier is ordinarily controlled to deposit less than the amount of liquid deposited upon development using a volatile liquid carrier, this so that there is less of the liquid carrier to be handled on the final copy after it is deposited on the paper.

Another type of developer using an essentially non-volatile liquid is one constituting liquid monomers which, after deposit on a substrate by use of this invention, can be cured in any suitable manner well known to the art such as exposure to heat or ultraviolet rays.

The present invention also may be employed with toners that react with the substrate to which they are transferred, creating a difference in the characteristics of the substrate surface as, for instance, a change in color at the points of deposit.

The constituents of the liquid developer which remain on the surface of the final copy may be further treated in a mode well known to the art and which does not constitute a part of this invention. For example, the constituents may be curable, that is to say, include monomers, or resins in a partially cured state, and they may be polymerized or otherwise cured on the final copy as by the application of heat.

Also optionally, the developer may carry chemical setting agents which are activated after deposit of the developer on the final copy. The activation usually will be by heat.

It also is contemplated that the developer may include a film-forming constituent. The film-forming constituent may be thermoplastic and rendered fluent by the application of heat. The film former will serve to tightly bind the solid constituents of the developer to the final copy without reliance upon adhesion of the solid constituents in the absence of such a film former.

Another type of developer contemplated for use in connection with the present invention, it being remembered that the specific functions of the different developers are not a critical aspect of the invention and the sundry descriptions of the different kinds of developers merely being set forth in order to appreciate the full scope of the invention, is a developer used to create an image that is to be employed as a printing master. Such developers have the ultimate aim, as is known in the graphic arts, of differentially treating a surface of a sheet or similar object that is to be used as a printing plate. Such a developer does not have to be visible. All that is required is that the developer differentially affect the surface of the object on which it is deposited. The type of differentiation employed will depend on the type of printing process that is to be used. For example, the developer simply may, by coating, render a portion of the surface on which the image is developed lipophilic, the surface itself otherwise being hydrophilic, or vice versa. Again, the developer may act as a coating resist, and the object which is thus developed thereafter may be etched in the uncoated areas, the coating subsequently being removed and the object functioning as a printing plate.

If desired, a developer may be used which will chemically react with the surface of the object on which it is deposited and the object thereafter is employed either for a decorative purpose or as a plaque or as a printing plate.

It is desirable, pursuant to the present invention, to include in the liquid developer an additional control agent which is not present in liquid developers such as have been mentioned. This control agent is one which enhances conductivity, that is to say, lowers resistivity. Typical such conductivity enhancers are, for aqueous-based liquid developers: aliphatic and aromatic organic compounds and derivatives thereof that are more polar than the solvent medium, the latter being either polar or non-polar, and which are soluble in the solvent medium and act to increase the dielectric constant thereof. Such compounds include monomeric, oligomeric and polymeric compounds containing one or more of the following functionalities:

Water soluble, ionizable compounds such as: neutral salts, e.g. sodium chloride and ammonium acetate; inorganic and organic acids, e.g. hydrochloric acid, sulfuric acid and benzoic acid; and bases, e.g. sodium hydroxide and trimethylamine; and surface active agents, these being compounds which, although insoluble in water, are capable of forming stable highly ionized micellular structures, such as: metal salts of organic acids, e.g. sodium laurylsulfonate and aluminum stearate; and for non-aqueous liquid developers: alcohols, e.g. dodecyl alcohol; phenols, e.g. p-dodecylphenol; acids, e.g. dodecanoic acid; esters, e.g. dodecyl acetate; amides, e.g. n-dodecylacetamide; acid halides, e.g. dodecanyl bromide; halocarbons, e.g. dodecyl bromide; amines, e.g. dimethyldodecylamine; aldehydes, e.g. dodecanal; ketones, e.g. 2-dodecanone; mercaptans, e.g. dodecyl mercaptan; and ethers, e.g. methyldodecyl ether; thioethers, e.g. phenyl dodecyl sulfide; sulfones, e.g. phenyl dodecyl sulfone; sulfoxides, e.g. phenyl dodecyl sulfonide; thiophenols, e.g. 2-methylthiophenol; thioethers, e.g. dodecyl thiodecanoate; disulfides, e.g. dodecyl disulfide; azos, e.g. azo bis isodecane; peroxys, e.g. peroxy didodecane; and surface active agents such as: metal salts of soluble fatty acids, e.g. sodium, potassium, ammonium, calcium, magnesium, zinc, lecithin, cobalt, iron, nickel and aluminum.

Other conductivity enhancers which can be used with organic solvent media are: Aerosol 0T which is di-2-ethylhexyl sodium sulfosuccinate; Aerosol TR which is di-tridecyl sodium sulfosuccinate; the aluminum, chromium, zinc and calcium salts of 3,5-dialkylsalicyclic acid, wherein the alkyl group is propyl, isopropyl, butyl, isobutyl, tertiary butyl, amyl, isoamyl nd other alkyl groups up to C-18; the aluminum, chromium, zinc and calcium salts of dialkyl gamma-resorcylic acid, wherein the alkyl is as above; the isopropylamine salt of dodecylbenzene sulfonic acid; aluminum, vanadium and tin dresinates (the metal dresinates are prepared by adding a solution of the metal sulfate to a solution of the sodium salt of Dresinate 731 manufactured by Hercules Powder Co.); aluminum stearate; cobalt, iron and manganese octoates; OLOA 1200 which is a product of the Oronite Division of California Chemical Co., the same being a partially imidized polyamine with lubricating-oil-soluble polyisobutylene chains and free secondary amines, its specifications are: gravity at 60° F. API 22.9, specific 0.92, flash point by the Cleveland open cup method, 425° F., viscosity at 110° F., 400 SSU, color (ASTM D-1500) L55D, nitrogen, percentage by weight 2.0, and alkalinity value, (SM-205-15) 43; soya bean oil; lecithin; an aluminum salt of 50—50 by weight mixture of the mono- and di- 2 ethylhexyl esters of phosphoric acid; and Alkanol DOA which is a product of E. I. duPont de Nemours & Co., Inc. (This product is a viscous light amber colored liquid composed 50 percent by weight of a terpolymer in kerosene. The terpolymer consists of 50 percent by weight octadecenyl methacrylate, 40 percent by weight styrene and 10 percent by weight diethylaminoethyl methacrylate. The specific gravity of the product at 77° F. is 0.888. Its acid number [milligrams KOH/gram of sample] is 0.2. Its total monomer content is 15.5 percent maximum by weight. Its basic nitrogen content is 0.40 percent ±0.03 percent by weight. Its base number [equivalent to milligrams KOH/gram of sample] is 13.8.)

In the event conductivity enhancers are employed, the amount thereof will vary from about 0.1 g/l to about 100 g/l.

Exemplificative suitable liquid developers are set forth below:

EXAMPLE I

Latex gloss trim enamel, Benjamin Moore Aquatrim

The pigment is 5.3% by weight of the enamel, and consists of 47.4% by weight of the pigment of carbon black and 52.6% by weight of the pigment of silicates. The vehicle constitutes 94.7% by weight of the enamel and is an acrylic emulsion of which the non-volatile phase is an acrylic resin in the amount of 29.8% by weight of the vehicle, and the volatile phase is a mixture of water and alcohol making up 70.2% by weight of the vehicle.

EXAMPLE II

Latex gloss enamel, Red Devil LF251 Bold Blue

The pigment is 5.6% by weight of the enamel, and consists of titanium dioxide and phthalocyanine blue. The vehicle constitutes 94.4% by weight of the enamel and is an acrylic emulsion of which the non-volatile phase is an acrylic resin, and the volatile phase is a mixture of water and propylene glycol.

EXAMPLE III

Latex gloss enamel, Red Devil LF254 Crimson

The pigment is 6.1% by weight of the enamel, and consists of toluidene red in an amount of 1.7% by weight of the enamel, arylide red in an amount of 2.1% by weight of the enamel and red iron oxide in an amount of 2.3% by weight of the enamel. The vehicle constitutes 93.9% by weight of the enamel and is an acrylic emulsion of which the non-volatile phase is an acrylic resin which is 27.6% by weight of the enamel, and the volatile phase is a mixture of water and propylene glycol which is 66.3% by weight of the enamel.

EXAMPLE IV

Latex gloss enamel, Red Devil LF252 Kelly Green

The pigment is 12.1% by weight of the enamel, and consists of titanium dioxide, Hansa yellow and phthalocyanine green. The vehicle constitutes 87.9% by weight of the enamel and is an acrylic emulsion of which the non-volatile phase is an acrylic resin and the volatile phase is a mixture of water and propylene glycol.

EXAMPLE V

Latex gloss enamel, Red Devil LF258 Jet Black

The pigment is 1.6% by weight of the enamel, and consists of lamp black. The vehicle constitutes 98.4% by weight of the enamel and is an acrylic emulsion of which the non-volatile phase is an acrylic emulsion of which the non-volatile phase is an acrylic resin, and the volatile phase is a mixture of water and propylene glycol.

EXAMPLE VI

Latex gloss enamel, Red Devil Hot Pink

The pigment is 10.3% by weight of the enamel, and consists of titanium dioxide, fluorescent pink (sulfonamineamide-aldehyde resin containing less than 3% by weight of fluorescein). The vehicle constitutes 89.7% by weight of the enamel and is an acrylic emulsion of which the non-volatile phase is a vinyl acrylic resin, and the volatile phase is a mixture of water and propylene glycol.

EXAMPLES VII–XII

The enamels of each of EXAMPLES I–VI are diluted with an equal volume of water, stirred and allowed to settle for an hour. Thereafter there is drawn off from the top a volume equal to the original volume which is used as a developer.

EXAMPLE XIII

| Ink: | % By Weight |
|---|---|
| Super IMPerse Jet Black (commercial aqueous carbon black dispersion sold by Hercules, Inc.) | 2–5 |
| Alkoxyacid sodium salt, sold by Universal Chemicals Corp. under the trademark Alkawet-B | 1 |
| Water | 94–97 |

EXAMPLE XIV

| Ink: | Grams |
|---|---|
| Dissolve together: | |
| deionized water, and | 100.0 |
| sodium hydroxide, crystal, | 4.3 |
| to form liquid A | |
| Mix together: | |
| deionized water, and | 50.0 |
| aqueous dispersion of a thermoplastic material sold by the Dow Chemical Co. under the trademark Dow 22 Emulsion | 100.0 |
| to form liquid B | |
| Mill liquids A and B cold for 20 hours together with: | |
| carbon black sold by Cabot Corp. under the trademark Mogul L, and | 100.0 |
| sodium salt of a condensed mono-naphthalene sulfonic acid sold by | |

-continued

| Ink: | Grams |
|---|---|
| Nopco Chemical Division of Diamond Shamrock Chemical Co. under the trademark Lomar PW | 27.0 |

EXAMPLE XV

| Ink: | Grams |
|---|---|
| Dissolve together: | |
| deionized water, and | 100.0 |
| sodium hydroxide, crystal, | 4.3 |
| to form liquid A | |
| Mix together: | |
| deionized water, and | 50.0 |
| an aqueous dispersion of styrene-butadiene rubber sold by Goodyear under the trademark Pliolite LPR 4181 | 100.0 |
| to form liquid B | |
| Mill liquids A and B cold for 20 hours together with: | |
| carbon black sold by Columbia Carbon Co. under the trademark Raven 850, and | 100.0 |
| sodium salt of a condensed mono-naphthalene sulfonic acid sold by Nopco Chemical Division of Diamond Shamrock Chemical Co. under the trademark Lomar PW | 27.0 |

EXAMPLES XVI–XX

Liquid electrostatographic image developers

EXAMPLES I–V of U.S. Pat. No. 3,669,886.

EXAMPLES XXI–XXV

EXAMPLES XVI–XX above diluted as described in lines 65–70 of column 8 of U.S. Pat. No. 3,669,886.

EXAMPLES XXVI–XXXVI

Toners

The concentrates of EXAMPLES XX–XXX of U.S. Pat. No. 3,900,412 which are the undiluted toners before the addition of the diluting solvents Isopar K, Isopar G or OMS.

EXAMPLES XXXVII–XLVIII

Toners

The concentrates of EXAMPLES XLI–LII of U.S. Pat. No. 3,990,980 which are the undiluted toners before the addition of the diluting solvents Isopar G, Isopar H or Isopar K.

EXAMPLES XLIX–LIX

Inks

Water containing any one of the following dyes:

| EX.: | NAME | COLOR INDEX NO. |
|---|---|---|
| XLIX | Crystal Violet | 42,555 |
| L | Malachite Green | 42,000 |
| LI | Methylene Blue | 52,015 |
| LII | Victoria Blue | 42,595 and 44,045 |
| LIII | Carmine Red | 75,470 |
| LIV | Nigrosine C 140 powder | 50,420 |
| LV | Chloramine Black Ex (dark) | 30,235 |
| LVI | Rayon Black C (double conc.) | 35,255 |
| LVII | Chris Cuprofles 3 LB | Direct Black 63 |
| LVIII | Alizarine Light Green GSN | 25 |

-continued

| EX.: | NAME | COLOR INDEX NO. |
|---|---|---|
| LIX | Lanasyn Brilliant Blue GL | Similar to C.I. Acid Blue 127 |

The foregoing dyes are present in the water in an amount of from about 0.1% to about 10% by weight.

EXAMPLES LX–LXVI

Inks

Water containing any one of the following pigments:

| EXAMPLE | NAME |
|---|---|
| LX | Ultramarine Blue |
| LXI | Cadmium Sulfite |
| LXII | Titanium Dioxide |
| LXIII | Zinc Oxide |
| LXIV | Iron Oxide |
| LXV | Aluminum Powder |
| LXVI | Bronze powder |

The foregoing pigments are present in the water in an amount of from about 0.1% to about 30% by weight, and there preferably is additionally present a suspending agent such as copoly(vinyl acetate/vinyl laurate) (80/20) or copoly(vinyl acetate/vinyl sterate) (85/15) in an amount of about 3% to about 10% by weight.

EXAMPLE LXVII

A toner which will react with the substrate to change the color of the substrate at the points of deposit A 28% water solution of ammonium hydroxide.

A typical substrate on which the ammonium hydroxide can be deposited is a paper substrate on which there is a coating of the following:

| | |
|---|---|
| Citric acid | 3.0 g. |
| 4-diazodiphenylamine sulfate | 3.0 g. |
| 2,3 dihydroxy naphthylene-6-sulfonic acid | 5.0 g. |
| Zinc chloride | 5.0 g. |
| Thiourea | 3.0 g. |
| Glycerine | 7.0 g. |

The coating is applied with the conventional coating equipment and dried. After imagewise deposit of the ammonium hydroxide solution thereon, the coating is exposed for 30 seconds to ultravoilet light having a wavelength of between 250 and 320 nm.

EXAMPLE LXVIII

In this example the toner is triethanolamine. It is applied imagewise to the same coating as EXAMPLE LXVII.

For EXAMPLES LXVII and LXVIII the reaction that takes place produces a dark colored image.

EXAMPLE LXIX

This is an example of a toner which is solvent-free

| | Parts by Weight |
|---|---|
| Styrene monomer | 9 |
| Mogul L | 1 |

The foregoing constituents are combined and ball milled for 16 hours. They are applied imagewise to a surface by the use of the present invention in the manner described heretofore and they are set, after imagewise deposit of the toner, by exposure for 5 minutes to ultraviolet light in the wavelength range of 250 to 320 nm.

EXAMPLES LXX AND LXXI

The toners of these two examples are the same as the toners of EXAMPLE LXIX except that instead of a styrene monomer, there is employed for EXAMPLE LXX a methylmethacrylate monomer and for EXAMPLE LXXI a butylmethacrylate monomer. The distribution of the pigment in the liquid is obtained in the same manner as for EXAMPLE LXIX as is the curing of the imagewise deposited monomer.

If desired, there may be added to any of the liquid developers adjuvants of well known types having conventional functions such, for instance, as adjuvants which increase or decrease surface tension, adjuvants which delay or speed up drying, adjuvants providing a binding function, and adjuvants which act as filming agents.

From the foregoing, it should be apparent that the particular type of liquid developer is not critical to the operation of this invention.

The sequence of events that take place at the development station and which results in the development of the electrostatic image best can be understood with regard to the FIG. 1 form of the invention by reference to FIGS. 2–9.

In FIG. 2 the developer roller 40, the film 42 of liquid developer and the photoconductor 44 (the elements of this figure show a continuous film of developer and an object having an electrostatic image on its surface; the figure also is applicable to liquid developing apparatuses of other forms and to any electric field image associated with a surface of an object) have been illustrated at the moment that an electrostatically charged segment 50 on the photoconductive surface is nearing but still is relatively remote from the development zone Z at the gap 46. In this figure only a single charged segment has been illustrated, the same being denoted by two negative charge symbols that conjointly constitute the segment in question. In this figure no externally applied electric field is indicated as being derived from the external source of voltage shown in FIG. 1. For the purpose of the initial description, such voltage will not be discussed with respect to FIGS. 2–9 but will be discussed subsequently. It will be recalled that the present invention will function satisfactorily in the absence of such a voltage which merely augments the transference, now to be described, of the liquid developer in a selective manner from the film 42 to the photoconductor 44 at the electrostatically charged segments.

While the segment 50 still is relatively remotely spaced from the development zone Z but at a certain point of its approach, as illustrated schematically, for example, in FIG. 2, the electrostatic charge on the segment 50 creates an electric field between this segment and the opposed portion of the liquid film 42. This electric field has been indicated by a series of dotted lines in the figure which are a diagrammatic representation of the lines of force. These are not to be taken as exactly representative. Indeed, although the lines are almost straight lines in this figure and in some of the subsequent figures, the lines become extremely complex and, therefore, have been omitted from some later figures. Furthermore, only the strongest field lines have been shown, i.e. those which most directly effect the raising of the liquid developer ultimately into the form of a pseudopod. It is known in the discipline of electric fields that lines of force initiate and terminate perpendicularly to the surfaces with which they are associated. The electric field is relatively weak in the FIG. 2 condition, compared to what the field will be at the development zone, because the segment 50 and the opposed portion of the film still are approaching each other and have not yet reached or even closely approached their zone of closest proximity. At this time, i.e. in the position illustrated in FIG. 2, the electric field will raise a slight bulge 52 in the film 42 in the portion of the film opposed to the segment 50. The radial height of the bulge 52 and the distance of said bulge from said segment 50 to the development zone Z are shown schematically, and any measurements taken from this figure are not to be considered as a limitation upon the invention.

FIG. 3 illustrates the relative positions of the developer roller 40, the film 42, the photoconductor 44 and the segment 50 at a slightly later point in time at which the segment 50 has approached more closely to the development zone Z and to the film than in FIG. 2. Because of the reduction of the space between the segment and the opposed portion of the film at this relative position of the various components, the electric field is stronger so that the bulge 52 has increased in radial height and has somewhat enlarged its base, being now more accurately described as a dome 54.

FIG. 4 illustrates a subsequent alteration in the shape of the bulge/dome at a later time, it being again observed that the assumption of the particular shape now to be described for the altered dome which is denoted by the reference numeral 56 is schematic as to the distance between this altered dome 56 and the zone Z. Phrased differently, the progressive changes in the shape of the portion of the film opposed to the segment 50 as the segment and said opposed portion of the film move toward the zone Z and each other is substantially correctly illustrated in the figures as to the changing shape of the bulge/dome, but the precise positions at which the successive changes in shape take place will vary with the actual spacing between the platen and the roller, with the type of photoconductor, with the magnitude of the charge of the electrostatic image, with the surface configuration of the roller, and with the specific liquid developer employed. In FIG. 4 there will be seen the initiation of a raised peak 58 at approximately the center of the dome. The peak is, as yet, not pronounced.

As the segment 50 moves closer to the zone Z (see FIG. 5) the peak 58 becomes better defined and increases in height as indicated by the reference numeral 60. The change from the height of the peak 58 to the height of the peak 60 actually takes place quite rapidly and is in the nature of the initiation of a spurt or jet of liquid from the altered dome 56 toward the segment 50.

The speed at which the jet or spurt is ejected from the altered dome 56 accelerates as the segment 50 moves closer to the zone Z, this being illustrated in FIG. 6 where the peak 62—a spike, i.e. pseudopod—extends quite far from the dome 56 toward the segment 50. There is a tendency for the volume of the altered dome to be somewhat reduced as more liquid flows from said dome into the pseudopod, the speed of the upwardly jetting liquid in the pseudopod tending to increase as the tip 64 of the pseudopod approaches the segment 50. The pseudopod also becomes quite slender.

Figure 7:
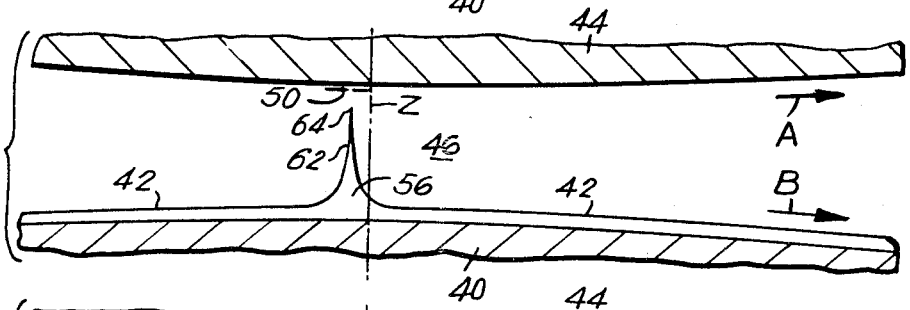

As the platen and developer roller continue to turn and the segment 50 almost reaches the zone Z, as illustrated in FIG. 7, the pseudopod 62 is further elongated and its tip 64 approaches very closely to the segment 50, said segment and said pseudopod at this moment being almost but not yet quite at the zone Z. At this time, the pseudopod still is jetting upwardly.

Attention is called to the fact that all of the changes in shape of the portion of the liquid film opposing the segment 50, which changes constitute progressive raising of the liquid, first as a bulge and dome and then as an upwardly jetting pseudopod at about the center of an altered dome, are motions of the liquid in the film against the forces exerted by gravity and surface tension.

Finally, the segment 50 reaches the zone Z (see FIG. 8) at which time the tip of the pseudopod touches the photoconductor 44 at the segment. The moment the tip of the pseudopod touches the photoconductor, three things are believed to occur. Firstly, the charge of the segment 50 may be partially discharged through the pseudopod, and the electric field created by said segment may partially collapse. Secondly, the liquid at the tip of the pseudopod tends to spread out along the surface of the photoconductor at the segment, at least because the charged segment of the photoconductor surface tends to be more wettable by the liquid than the uncharged surface. Thirdly, liquid is drawn up from the pseudopod onto the surface of the photoconductor by virtue of surface tension, and, at the same time, the pseudopod at the region slightly spaced from the surface of the photoconductor thins to an extent (not shown) such that the pseudopod snaps and the liquid in the pseudopod below the breaking point and in the dome falls back into and reconstitutes the radially quiescent state of the film 42 as illustrated in FIG. 9. This rupture of the pseudopod is aided by virtue of the divergence of the photoconductor and the developer roller as they leave the development zone.

A droplet 66 remains on the photoconductor surface. This droplet, if the photoconductor at the charged segment is wettable by the liquid developer (e.g. the photoconductor is zinc oxide in polyvinylacetate on a paper backing and the liquid developer is an aqueous developer), tends to spread out. It is extremely difficult, owing to the restricted space which it occupies and to its fleeting nature, to measure the size of a droplet; however, it is thought that it ranges from about 0.5 to about 50 mils in breadth and, of course, will depend, among other things, on the size of the segment 50.

Adjacent pseudopods within an electric field image are closely spaced as are the liquid developer drops that are transferred and deposited on the object with which the field was associated.

It is appropriate, here, to consider FIG. 16 which illustrates an alternate method of transfer of a droplet of liquid developer from the film 42 to the photoconductor 44 at the segment 50. In this figure a position has been shown for the segment which corresponds to the position of FIG. 8, i.e. when the segment 50 has reached a point of close proximity to the zone Z, and the tip of the pseudopod 62 has approached but not quite reached the photoconductor 44. In the condition illustrated in FIG. 16, the spacing at the gap 46 is sufficiently large for the jetting pseudopod 62 not to touch its tip to the photoconductor 44 at the segment 50 but, rather, under the influence of the local electric field, for the tip of said pseudopod to become detached from the pseudopod and move under the influence of said local electric field to the photoconductor at the segment 50. In FIG. 16 the detached tip is shown in the form of a droplet 68 moving rapidly toward said segment 50. As in the case of the pseudopod, the tip of which eventually touches the photoconductor, the separation of a droplet from the tip of the pseudopod, as illustrated in FIG. 16, is opposed by gravity and surface tension which, however, as in the case of the tip of the pseudopod touching the photoconductor directly, are overcome by the local electric field. The flight of the drop is opposed by gravity which likewise is overcome by the local electric field.

A theory of pseudopod and droplet formation under the influence of an electric field which was developed in connection with the action of water drops in strong electric fields in thunderstorms is discussed in the article entitled "Disintegration of Water Drops in an Electric Field" by Sir Geoffrey Taylor, F.R.S., at pages 383–397 of *Proc. Roy. Soc. A*, volume 280 (1964).

Equally important to an understanding of the present invention is the behavior of pseudopods, and detached droplets if the same are present where there is not electrostatically charged segment on the photoconductor, or no electric field, that is to say, where a background exists which is not to have a droplet or droplets of the liquid developer deposited thereon by transference from the film 42.

When there are many charged segments, pseudopods upon occasion will be formed in portions of the film opposed to the background. These are believed to be due to the interplay between closely adjacent electric fields or to other external influences. Such pseudopods also may be initiated by mechanical vibrations. Even if such undesired pseudopods are raised, and even if a droplet should detach from the tip of an undesired pseudopod, there seldom is any deposit of the liquid developer or an uncharged or partially discharged segment because, it is believed, of the counteracting force of gravity and/or surface tension on such pseudopods. It has been found that where the various parameters mentioned above for the apparatus and the liquid toner are observed, and principally where the minimum spacing between the suface of the film of liquid developer and the surface of the photoconductor at the development zone is not less than 1 mil, the liquid developer does not contact the background because, it is believed, gravity and/or surface tension prevent the liquid developer from reaching the photoconductor even if undesired pseudopods or droplets are created. The speed at which the jet is engendered, the height to which the jet extends, and the velocity of a droplet, if formed, are not sufficient, it is believed, to overcome gravity and/or surface tension to an extent such as to permit any liquid developer to reach any uncharged segments, so that the background of the photoconductor generally remains in its virgin state whereby high contrast, good line definition and clarity of image are insured.

The pseudopods, as described at length above, do not invariably form to a slender highly extended state such as illustrated in the figures. Thus, if the gap spacing is quite small, i.e. of the minimal order of spacing mentioned above, it is believed that the pseudopods may only be bulges or domes the tips of which reach the opposed surface. It has not been possible, due to the very small dimensions involved at the minimum gap spacing and to the rapid formation of the pseudopods, to clearly examine pseudopods while the developer roller and the electric field are moving, although it has been possible to examine the formation of bulges, domes and pseudopods in a static state, that is to say, where said developer and field are stationary. However, the formation of pseudopods, in addition to being demonstrated by static models, is corroborated by the nature of the droplets deposited, i.e. the nature of the developed image.

Figure 10:
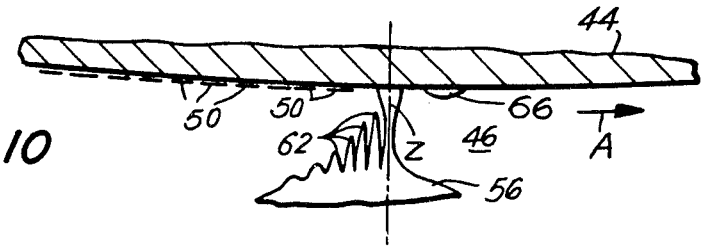
FIG. 10 is a view similar to FIG. 8, but illustrating plural, closely spaced charged areas of an electrostatic image on the photoconductive surface.

FIG. 10 schematically illustrates the configuration of the developer film at the development zone when there are many closely spaced segments 50 as, for example, where there is a solid area of image which is to be developed. In this case, the altered dome 56 has a large number of spikes, i.e. pseudopods, 62 formed therein, the same progressively increasing in height as the development zone is approached until at or on approach to the development zone spike after spike touches the photoconductor 44 to deposit droplets 66 thereon which, if sufficiently close to one another, will merge. Depending on the gap spacing at the zone, i.e. if the spacing is sufficiently large, a series of droplets may be formed, one for each of the spikes or jets, which will fly toward the photoconductor 44. It will be understood that the pseudopods formed by any given image segments are closely spaced to one another within the confines of that image segment.

Although mention has been made of the fact that it is believed that the droplets tend to become detached from the tips of the spikes as the gap 46 increases, rather than having the tips of the spikes touch the photoconductor, it is believed that the distance alone does not control the formation or absence of the droplets which also depends, it is believed, upon other factors such as the speed of movement of the developer roller and photoconductor, the surface configuration of the roller, and the viscosity, the density, the surface tension and the conductivity of the developer liquid. Both modes of development at the development zone, these being the touching of the tips of the spikes and the detachment of droplets which fly to the photoconductor, are indistinguishable variations in the practice of this invention.

Pseudopod transference of the liquid developer will occur as soon as the electric field of the image is strong enough to cause it to take place, which will be when the surface of the developer is close enough to the object with which the electric field is associated. Such proximity of the object and the surface of the developer may be prior to the closest approach of the object to said surface at the zone Z.

In FIG. 11 an extrapolated configuration of the film 42 is illustrated for a few widely spaced segments 50 as they are believed to appear. It will be observed that the sundry domes 54 tend to blend into one another and that the bulges and spikes are formed as the domes approach the development zone Z.

FIG. 1 indicates the presence of an external electric field applied to the development zone Z by a potential applied between the platen 22 and the developer roller 40 by slip rings, the developer roller being electrically conductive. The externally applied field preferably has a direction the same as that created by the electrostatic charge of the segments 50 whereby to supply an additional electric field between the developer roller and the photoconductor which augments the electric field created by the segments 50, although it may oppose the same if desired in case, for example, the electric field (associated with the segments) is of too great an amplitude which might result in ionization and an electrical discharge that would prevent transfer by pseudopods of developer liquid across the gap. It will be understood that even with this auxiliary electric field the balance of forces on the pseudopods is such that the tips of pseudopods or the droplets seldom reach an uncharged segment, i.e. a background uncharged segment.

Typical voltages for creating an external electric field range from about −1,000 volts to about +1,000 volts, preferred values being less than 200 volts. This voltage, if used, is selected to be of a proper magnitude and direction to assure that liquid developer is transferred to a photoconductor so as to form the desired image but without the creation of an ionization of air in the gap and an electric discharge at this zone.

FIG. 12 has been included simply to show a dome 54, as it is believed to appear, with an associated spike 62 in the background and another dome and spike in the foreground, the latter spike being at the development zone Z and the former dome and spike still not having reached the development zone.

FIG. 13 has been included to illustrate the extrapolated appearance of a dome 54 having a pair of spikes 62 jetting therefrom toward a pair of closely spaced charged segments 50, indicating that, where the segments are spaced closely enough together, only a single dome 54 may be formed from which commonly the pair of spikes jet upwardly.

Figure 8:
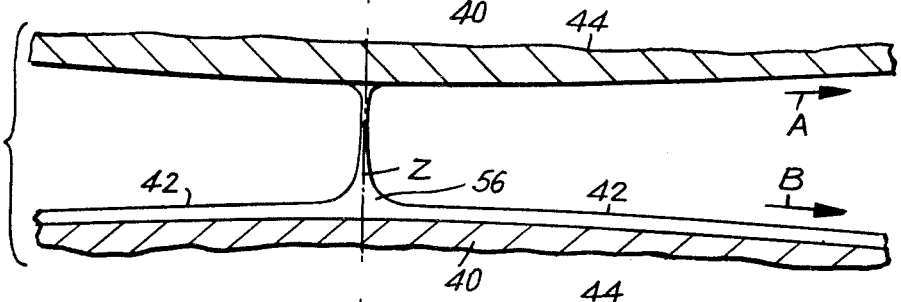
Figure 9:
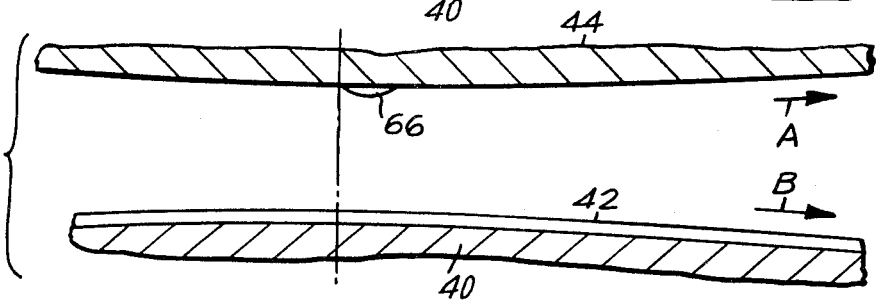

FIG. 14 is similar to FIG. 8, the difference being that the photoconductor 44 is not wettable by the liquid of the film 42, so that the tip of the pseudopod 62 as it contacts the photoconductor tends to form a convex meniscus 70, and the droplet 72 left upon collapse of the dome and spike likewise has a convex meniscus where it touches the photoconductor (see FIG. 15).

The functioning of the present invention depends upon the presence at the development (pseudopod transference) zone of a pool of liquid developer from which closely spaced pseudopods are raised to contact the opposed spaced photoconductor at charged segments or have their tips detached to form droplets which contact the opposed spaced photoconductor at charged segments. One method of providing such a pool has been described with respect to all the previously discussed figures, to wit, by creating a film of liquid developer on a rotating horizontal roller at the development zone. There are, however, acceptable alternates to this arrangement, one of which is shown in FIG. 17.

Basically, the pool is provided, as shown in this figure, by a capillary passageway or passageways which extend from a body of liquid developer at the lower end of the passageway to a pool at the upper end of the passageway, the pool being located at the development zone. The capillary passageway or passageways can be created in various fashions. For example, a sieve or perforated plate with vertical perforations may be located in the vicinity of the development zone with the bottom of the sieve or plate in contact with a body of a liquid developer beneath it and with the openings in the sieve or plate being of capillary dimensions of sufficient size to permit the liquid to rise in the capillary passageway or passageways to the top or tops thereof from which liquid can be drawn upon the approach of a charged segment 50 to pull up a pseudopod with the results described heretofore.

More particularly, in FIG. 17 the reference numeral 74 denotes a body of developing liquid at the development zone and spaced below the photoconductor. Disposed in said body is a pair of parallel vertical plates 76, 78 spaced apart to define a vertical passageway 80 of capillary width up which a capillary sheet 82 of developing liquid rises by virtue of capillary action. As charged segments pass over the upper ends of the plates and spaced therefrom by the gap spacing above described, i.e. at least 1 mil, bulges and domes 84 will be raised from the upper end of the capillary sheet 82 from which pseudopods will spurt upwardly in the manner already described to develop charged image segments. In the operation of a developing mechanism as shown in FIG. 17, the preliminary low bulges may not be formed in the configuration previously described, since, as the charged segments reach a region above the upper edge of the capillary sheet 82, the electric field may raise the liquid into pseudopods almost instantaneously.

Figure 18:
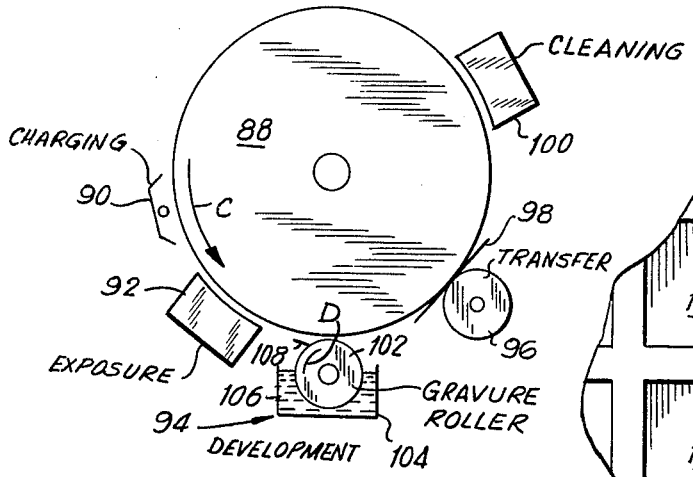
FIG. 18 is a schematic view similar to FIG. 1 of another embodiment of the invention in which the developer roller has a gravure surface.

In FIG. 18 another form of apparatus 86 is illustrated. Said apparatus is somewhat like the apparatus 20 shown in FIG. 1. It differs therefrom in the configuration of the surface of the roller 88, the absence of the web 24, and the use of a transfer sheet. More particularly, in the apparatus 86 the roller 88 is a drum having a photoconductive surface, for example, a selenium surface. This surface is smooth and highly finished. The direction of rotation is indicated by the arrow C. The drum has a charging station 90 associated with it, this constituting one element in the conventional means for providing an electrostatic image on the drum. Beyond the charging station in the direction of rotation of the drum is an exposure station 92. The combination of the charging station and the exposure station creates electrostatic images on the drum in a manner similar to that described with respect to FIG. 1. Beyond the exposure station in the direction of rotation of the drum is a development station 94, the details of which will be set forth below. At the development station the electrostatic image is developed by rendering the same visible through the pseudopod deposition of liquid images in the configuration of the electrostatic images. After the development station, a transfer station 96 is provided at which the toned image will be transferred to a transfer sheet 98 in a fashion well known to the art. To make certain that the drum is clean, if all of the liquid image is not transferred, a cleaning station 100 is provided following the transfer station, the use of such a cleaning station likewise being well known in the art. The cleaning station also may include means to discharge any residual electric potential on the drum, the use of such a discharge means likewise being well known in the art.

The apparatus 86 is conventional except for the development station. Instead of using a developer roller such as the roller 40 described with respect to FIG. 1 which has a smooth surface, the apparatus 86 includes a developer roller 102 the surface of which is broken up into a myriad of minute discrete cells.

Figure 20:
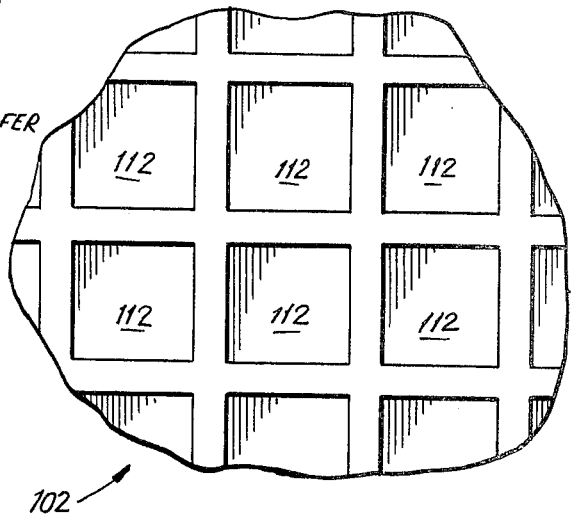
FIG. 20 is a fragmentary developed view of the surface of the developer roller of FIG. 19.
Figure 19:
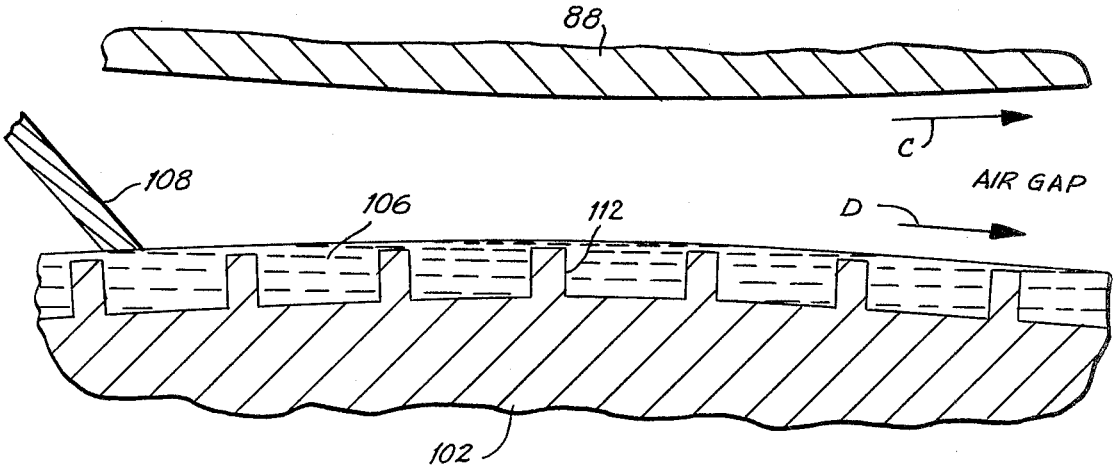
FIG. 19 is an enlarged transverse sectional view of the developer roller of FIG. 18.

The scale to which FIG. 18 is drawn is not sufficiently large to illustrate these cells. Therefore, reference is directed to FIGS. 19 and 20 in which the nature of the surface of the developer roller is more explicitly seen. Said surface essentially constitutes a gravure surface, as this term is understood in the printing art, this being a surface consisting of a large number of tiny discrete shallow depressions which cover the entire surface of the roller to be used for development purposes. The depressions may be of any configuration. Square depressions are illustrated by way of example only. The dimensions of the depressions can vary considerably. A typical measurement for the transverse dimensions of the open mouth of a depression, this being the portion of the depression at the surface of the developer roller, is 5 mils, and a typical depth is 2 mils. A typical spacing between adjacent depressions, longitudinally of the roller and circumferentially of the roller, is 1 mil. These figures will, of course, vary depending upon the degree of image detail to be furnished with any particular apparatus.

The developer roller 102 is mounted to turn partially submerged within a tray 104 containing a body of developer liquid 106. Said roller has a horizontal axis of rotation parallel to the horizontal axis of rotation of the drum 88 and is turned by a suitable source of power (not shown) in a direction D. It is desired for the developer roller to have on its exposed surface, which rises above the level of the liquid in the tray 104, liquid developer substantially only in the cells of the gravure surface. Excess liquid is removed by doctor means. Any well-known structure of doctor means may be used as, for example, a doctor blade 108 (see also FIG. 19). The spacing between the doctor means and the roller is such that the doctor means is almost at the surface of the developer roller to remove substantially all developer liquid at the raised areas separating the shallow depressions (cells) 112 so that the level of liquid left in the depressions is adjacent the mouths of the depressions. A very thin film of liquid developer, well below 1 mil in thickness, may remain on the surfaces of the raised areas between the cells, due to incomplete wiping action of the doctor means.

The developer roller 102 is spaced slightly from the surface of the drum to leave an air gap (best shown in subsequent figures) of a magnitude such as described previously, for example, 2 mils between the drum and the surface of the developer in the cells. This ensures that the liquid developer in the depressions does not contact the surface of the drum and only will reach the surface of the drum under the conditions specified heretofore, i.e. as tiny amorphous pseudopods. The manner in which this transfer is effected from the gravure surface of the developer roller is described subsequently.

The absolute speeds of the drum 88 and of the developer roller 102 are those mentioned previously with respect to the platen 22 and the developer roller 40. Preferably, the drum and the gravure roller are turned at matching speeds.

The transfer of the liquid developer in the form of pseudopods from the gravure surface of the developer roller to the surface of the photoconductive drum for the purpose of forming a physical material image on the drum, and which transfer relies on the presence of an air gap and an electric field image between these two surfaces, cannot be seen to the scale at which FIG. 18 is drawn. In order better to be able to appreciate the mode of transfer in this form of the invention, a series of figures, namely, FIGS. 21–28, has been included wherein the developer roller and the drum have been shown to a greatly enlarged scale, only fragments of the two surfaces being illustrated. None of the various parts there shown nor the spacing between them is strictly to scale.

Both the drum and the developer roller of which portions are shown in FIGS. 21–28 are cylindrical. Both of these may be of the same radius. However, as illustrated in FIG. 18, the drum has a greater radius than the developer roller. Nevertheless, for convenience, in FIGS. 21–28 the drum and the developer roller have been illustrated as having substantially the same radii.

The developers that can be used in the apparatus 86 are the same developers as those mentioned hereinabove.

Figure 21:
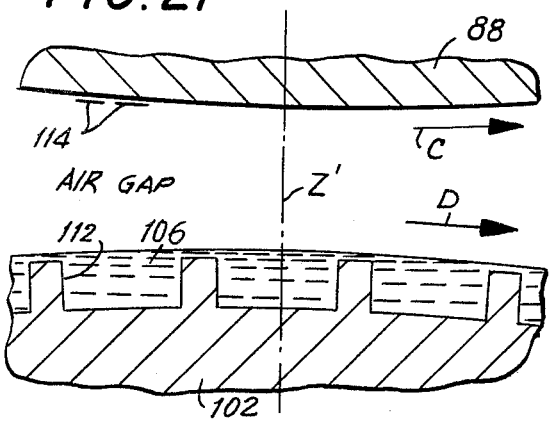
FIGS. 21 through 28 are highly enlarged views of the development zone of the apparatus of FIG. 18 showing progressive stages leading to and following pseudopod development of a single charged area of an electrostatic image in a photoconductive surface by the liquid developer contained in a single cell of a gravure developer roller.

In FIG. 21 a single charged segment on the drum 88 is denoted by the reference numeral 114 at a point preceding the development zone Z'. The charged segment at this time is spaced sufficiently far from an associated depression 112 for the electric field associated with the segment not yet to have affected the configuration of the developer liquid 106 contained within said depression.

Figure 22:
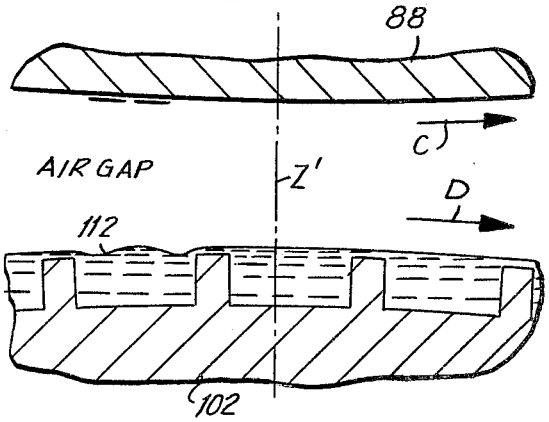

FIG. 22 illustrates the relative position of the parts and the configuration of the surface of the developer liquid in said depression 112 at a slightly more advanced point in time when the charged segment and the associated depression are slightly closer to the development zone Z'. Bearing in mind that the configuration of the liquid in the depression will be influenced by many elements and that, therefore, the configuration of liquid as shown in the drawings is idealized, referring to FIG. 22, which is the next advanced position beyond FIG. 21, the surface of the liquid developer in the depression at the center of the depression is slightly raised, which is the equivalent of the bulge 52 in FIG. 2.

It should be observed that the variation in configuration of the body of liquid within the cell and which will be described in the series of FIGS. 22–28 is believed to be experienced without a change in the absolute volume of the cell-contained liquid developer. In the several figures this variation appears as a transformation of the shape of the upper surface of the liquid in the cell. It is intended in these figures that the volume be shown as remaining constant.

Figure 23:
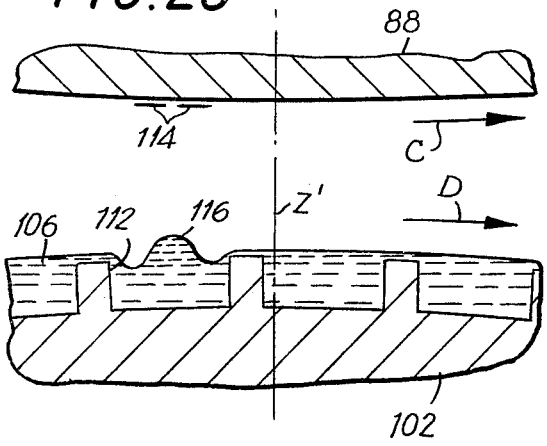

FIG. 23 illustrates the relative positions of the parts and the configuration of the surface of the developer liquid in said depression 112 at a point slightly more advanced in time and position than that of FIG. 22. At this point the charged segment and the depression are slightly closer to the development zone Z' and to each other. As shown in said FIG. 23, the center of the surface of the liquid in the cell has developed a distinct bulge or belly 116.

Figure 24:
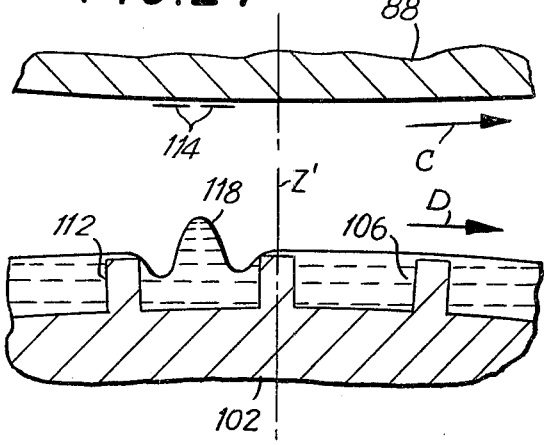

The aforesaid bulge 116 has become even more pronounced in the subsequent position illustrated in FIG. 24. The bulge, now denoted by the reference numeral 118, has increased in height and there has been a corresponding decrease in height of the surrounding surface of the liquid in said depression.

Figure 25:
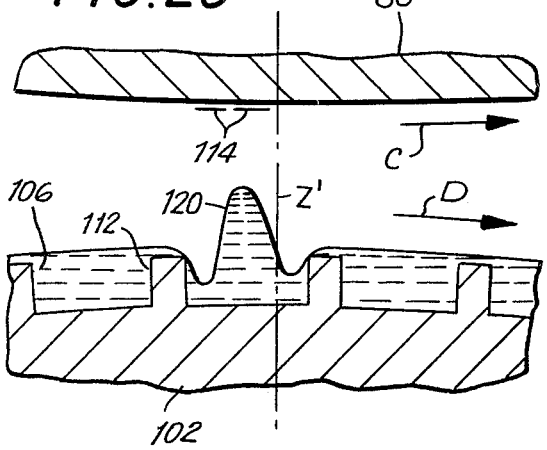

By the time the parts have reached the position illustrated in FIG. 25, the bulge, now denoted as 120, has risen considerably higher and the depression in the surrounding surface has become even more pronounced.

Figure 26:
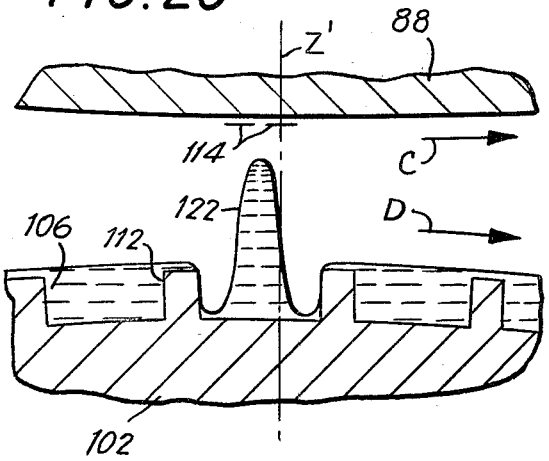

The position shown in FIG. 26 is immediately before pseudopod transference and, at this time, the bulge, now represented by the reference numeral 122, has risen still higher and its tip is in proximity to the drum 88 but has not yet reached the same. The bulge at this time has assumed the elongated form of a pseudopod, the transverse cross-section of which is roughly circular. This cross-sectional configuration is referred to herein as amorphous, indicating that the cross-section is not in the shape of the charged segment but, rather, is governed by the various physical forces such as surface tension acting upon this tiny raised column of liquid that has been lifted under the influence of the electric field.

In the several figures just described, namely, FIGS. 21–26, the progression in change of shape of the liquid in the cell has been illustrated in a series of steps that are neither uniformly spaced in time or rotary movements of the developer roller and drum. Moreover, the transformation in configuration of the developer liquid in the cell that has been shown is representative and will vary, depending upon the configuration of the electric field and the composition of the developer and the material and surface of the developer roller. It also is within the scope of the invention to raise more than one pseudopod from a given cell, depending upon the surface area of the cell.

Figure 27:
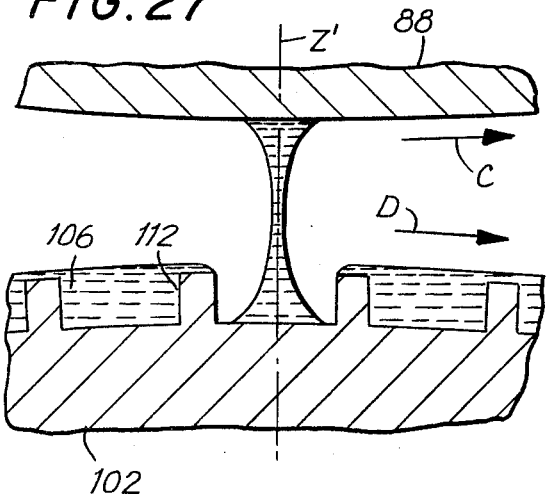
Figure 28:
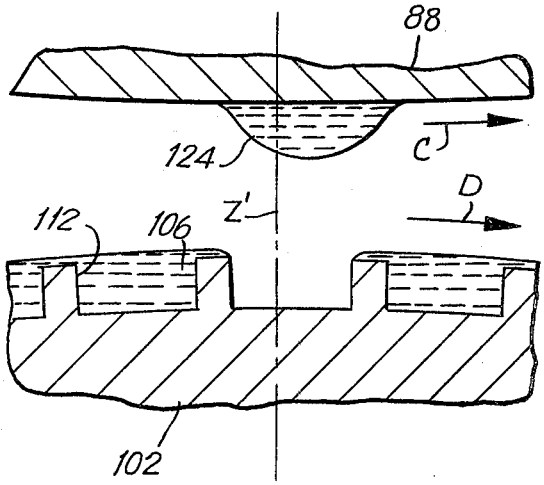

As the roller and drum continue to turn, the charged segment and the center of the cell will reach the development zone Z' as illustrated in FIG. 27. At or shortly prior to this time and position, the tip of the pseudopod will touch the developer drum. In FIG. 27 the drum has been shown as being composed of a material such that it is wetted by the developer liquid. Hence, the upper end of the pseudopod which now touches the drum has spread somewhat on the surface of the drum which is wetted thereby. As this occurs, the liquid still remaining in the cell is pulled up, i.e. transferred, to the surface of the drum. Typically, with cells of the order of magnitude described heretofore the transfer of the liquid from the cell is substantially complete, it being within the purview of the invention that some liquid still may remain in the cell. The liquid that has been thus transferred via a pseudopod forms a droplet denoted as 124 and illustrated in FIG. 28. This droplet has been illustrated as one which wets the surface of the drum and is shaped by surface tension into the configuration of a dome.

Reviewing the mechanics of the transfer of developer liquid via pseudopods from a developer roller to an object having an associated electric field image, in conjunction both with a smooth surfaced developer roller or a roller with an irregular surface such, for instance, as the cells just described, the principal feature of this invention constitutes the raising of a local area of the liquid developer surface located in close proximity to, but spaced from, the object, under the influence of an electric field image extending between the object and the liquid developer, the raised local area progressively increasing in height and decreasing in cross-section, particularly at the center thereof, until the raised area assumes the shape of a tiny amorphous pseudopod the tip of which contacts the object or is detached from the pseudopod and flies to the object, the developer liquid then adhering to the object. Individual pseudopods are not in the configuration of the electric field image. Indeed, if the electric field image is of any substantial size, e.g. that of an ordinary typewriter character, the individual closely spaced pseudopods raised will be considerably smaller than the image and it is only a group of closely spaced pseudopods which eventually conjointly will constitute the developed image. In this connection, it is noted that the cross-section of a typical pseudopod tip is in the order of magnitude of about ½ mil in diameter.

From the foregoing, it will be appreciated that the cross-sectional configurations of single pseudopods are essentially independent of the particular configuration of the electric field image at the point of pseudopod transfer.

It will be apparent that where a gravure roller is used the volume of liquid available to form any particular pseudopod, particularly where the cells are of the order of magnitude above mentioned, is fixed and constant for each cell, in contrast with a smooth surfaced developer roller where a much greater reservoir of liquid is available to form a pseudopod, so that in the case of a smooth surfaced developer roller the sizes of the pseudopods may vary somewhat from one to another, although in most cases the cross-sectional configuration of individual pseudopods will not vary substantially from the circular.

The sites on the object with which electric field images are present to raise pseudopods that determine the configuration of the imge to be formed will not always coincide with the sites on a gravure roller where liquid is available for the raising of a pseudopod. In the case of a smooth surfaced roller, liquid developer is available as a broad film over what constitutes essentially the entire area with which an electric field image might be located so that, regardless of the particular placement of any individual segment of an electric field image, there are corresponding segments of liquid developer ready to be transformed into pseudopods directly within that electric field segment. In that event, individual pseudopods tend to have their tips or drops from their tips disposed within the confines of the electric field image segment and not to extend beyond the peripheries of the image segments at the surface of the object.

However, where the liquid available on the developer roller is physically segregated into discrete finite volumes, the locations of the liquid bodies available for forming pseudopods will not necessarily coincide with the locations of the electric field image segments. This is particularly true of developer rollers of the gravure type where the liquid developer is available in discrete, i.e. unconnected, cells. In this case, particularly, there can be no certainty of coincidence, and there is a possibility of non-coincidence between cells and electric field image segments. The likelihood of coincidence or non-coincidence will be affected by the relative sizes of the center-to-center cell dimensions and of the image segments.

Thus, with a gravure developer roller the pseudopods which are raised from some individual cells may be out of registration with the electric field image segments at the surface of the object. Therefore, some pseudopods that are raised may not have their tips or drops from their tips invariably lie entirely within the boundaries of electric field image segments at the surface of the object. Accordingly, drops of the pseudopod-transferred liquid developer will, to some extent, lie on the surface of the object with portions of the drops extending slightly beyond the perimeters of the electric field images at the surface of the object. Pseudo-transferred closely spaced drops tend to be disposed within the confines of the electric field image segments at the object because of the influence of the field in tending to direct liquid from the pseudopods within these confines (leaning of the long axes of the pseudopods toward the image segments where non-coincidence occurs) and possibly because of some surface travel of the transferred liquid after deposit on the object.

It will be understood that the physical material image ultimately formed will, because of the mode of transfer of liquid by numerous closely spaced tiny pseudopods and the ensuing tendency of the thus-formed image to have a pointilistic structure, be composed of minute developed image areas, some of which may blend or run together and others of which may remain wholly or partially discrete. An observer's eye, however, will, because of optical resolution, tend to have these individual areas mutually blend. Where the developer roller is smooth surfaced, the mutual spacing of the deposited drops is controllable by developer and machine parameters, and requires a careful regulation of parameters. Where a gravure roller is employed, resolution can be controlled by the sizes and mutual spacings of individual cells and, under many conditions of use, such a roller may be preferred for that reason.

The physical blending or merging of drops in the developed image is believed to depend upon various factors. For example, if the surface of the object or the surface of a copy sheet from which an image is transferred from the object is wettable with the developer liquid, adjacent drops in a developed image will, if sufficiently close to one another, merge or blend, which usually is desirable. There also is a tendency for the flow of the liquid transferred by the pseudopod method of the present invention to be inhibited from movement externally over the boundary of the electric field image or encouraged within the electric field image. Another factor which tends to aid in blending the drops constituting the image is the scattering which may occur where the pseudopod has a sufficient momentum. This effect, too, is restricted or aided as aforesaid by the electric field, so that the merging or blending still tends to maintain the integrity of the developed image and not to extend beyond the perimeter of the segment.

It will be appreciated from the discussion of the method and structure of the present invention that the presence of a gap between the developer roller and the object with which the electric field image is associated is necessary for the creation of a pseudopod transfer of the developer liquid. Where the gap is large, the various factors which affect the transfer must be much more closely controlled in order to effect a proper transfer according to this invention than with a smaller gap. For example, the properties of the liquid must be carefully tailored to the gap and to the mechanical structure which is employed, and a high potential must be employed for the electric field if the pseudopod transfer is over a substantial distance. The criticality of these sundry factors lessen as the gap becomes smaller. At smaller gaps it is far easier to effect a pseudopod transfer of the liquid; the pseudopods do not have to be raised as high, the time that it takes to raise a pseudopod is reduced, and the time of transfer of liquid from the body of developer liquid to the object is lessened. But reducing of the size of the gap creates other problems, particularly when the gap becomes quite small, for example, in the order of 1 to 2 mils. This reduced size of the gap lends itself to different kinds of problems. As the gap becomes quite small, mechanical variations occur which may cause the surface of the liquid developer to touch the surface of the object, resulting in uncontrolled transfer of the liquid developer to the object. These variations may occur in the circularity of the developer roller and/or the object, and in the play of the bearings of either of these members.

Figure 29:
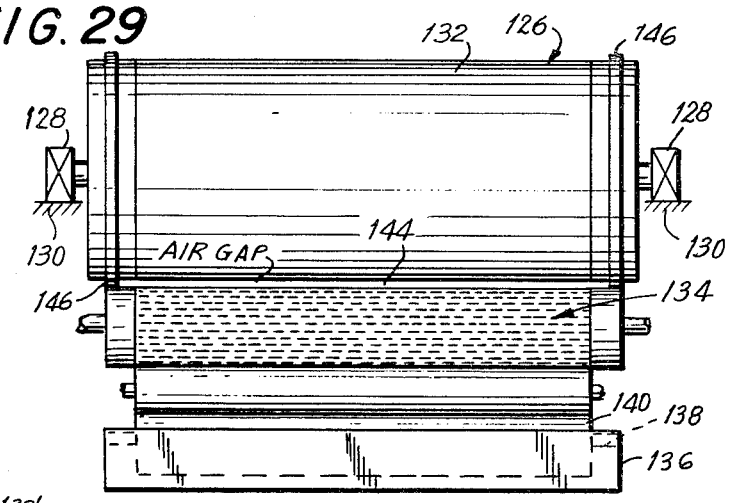
FIG. 29 is a front view of another embodiment of the invention in which the gap spacing is obtained by having annuli on the photoconductive drum ride on the developer roller.
Figure 30:
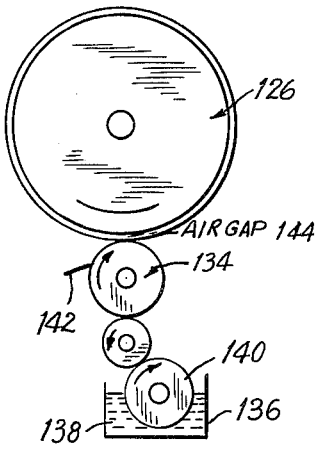
FIG. 30 is a side view of the embodiment shown in FIG. 29.

Such difficulties can be avoided by employing a structure such as shown in FIGS. 29 and 30 which does not, however, eliminate any problems with respect to linearity of said roller and object. It has been assumed that with the apparatus of FIGS. 1 and 18 the objects and the developer rollers have their own bearings, all on stationary supports. The modification of the invention illustrated in FIGS. 29 and 30 employs a different principle. In this modification the bearing supports for either the object or the roller are stationary but the other member does not have stationary bearing supports. Instead, the member without the stationary bearing supports rides on the other rotary member (the one having the stationary supports), being maintained in predetermined gap relationship with respect thereto by two spacer annuli. The annuli are carried by either member. If there is a difference in electric potential between the two members at the locations of the annuli, the spacer annuli are either made of electrically insulating material or are coated with such material. It is advantageous, generally, to use such insulation to avoid problems that may arise.

Referring, specifically, to FIGS. 29 and 30, the reference numeral 126 denotes a drum, the ends of which are carried by bearings 128 that are attached to a stationary element 130. The drum 126 has a photoconductive surface 132, e.g. a selenium layer, the edges of which terminate short of the ends of the drum. The photoconductive surface has electrostatic images provided thereon as described in detail with reference to FIG. 1. Associated with the drum 126 is a gravure developer roller 134. The structure associated with this developer roller differs from that shown in FIG. 1 for providing a thin layer of developer liquid thereon. Said structure includes a tray 136 containing liquid developer 138 in which a rotating pick-up roller 140 is partially submerged. The liquid thus raised is applied to the developer roller 134 by a transfer roller. A doctor blade 142 removes excess liquid from the developer roller. A gap 144 is provided between the developer roller and the drum at the development zone. The gap is exaggerated in FIGS. 29 and 30 for ease of illustration.

In FIG. 1 the developer roller and the drum are supported on stationary bearings (not shown in that figure) the locations of which determine the gap spacing. The tolerances of the bearings influence the minimum commercial gap that can be reliably provided in the equipment.

A different arrangement is employed for providing this spacing in the apparatus of FIGS. 29 and 30. This constitutes annuli 146 on and adjacent the ends of the drum 126. These annuli have been exaggerated in FIGS. 29 and 30 the better to see the same, since the sizes of the drawings does not permit scale reproduction. The peripheries of the annuli exceed that of the drum by the gap spacing to be obtained. Thus, if the gap spacing is to be 2 mils, the radii of the outer surfaces of the annuli are 2 mils greater than the radius of the drum.

As indicated above, the annuli preferably are of electrically insulating material. For better control of the gap, the material of the annuli is essentially incompressible. It is interesting to observe that the configurations of the peripheries of the annuli are of identical configuration and are concentric.

The radii of the annuli must be identically greater than the radius of the drum at all rotational positions on the annuli and drum. Where this condition is maintained, the particular shapes of the roller and of the drum are not critical. Desirably, the drum and the roller are circular, but it will be understood that if neither is circular, the gap spacing, nevertheless, will be maintained under the proviso just mentioned.

The annuli are kinematically unitary with the associated drum. Means (not shown) is provided to urge the drum and roller toward each other. In the illustrated embodiment of FIGS. 29 and 30 where the drum turns about a stationary axis, such means constitutes biasing elements such as springs to urge the developer roller toward the drum.

Figure 31:
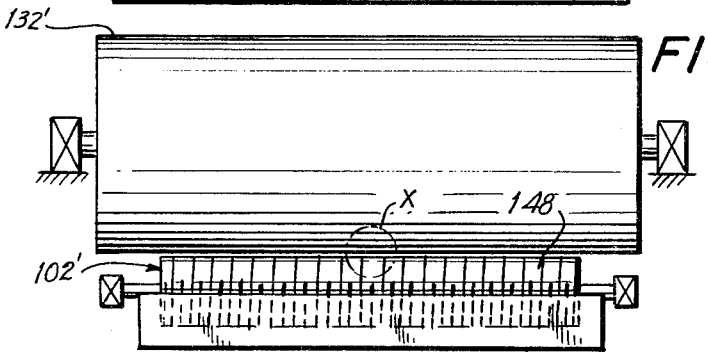
FIG. 31 is a front view of another embodiment of the invention in which the developer roller has a threaded surface.
Figure 32:
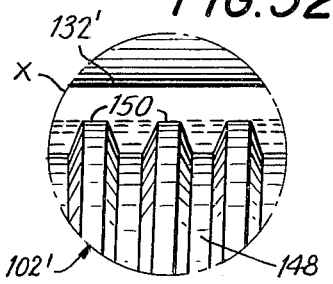
FIG. 32 is an enlarged view of the elements within the circle X of FIG. 31.

Instead of breaking up the smooth surface of the developer roller into individual discrete cells such as described above with reference to FIGS. 19 and 20, the surface may be so broken up as to provide a non-continuous but connected depression. Such a surface is illustrated, for example, in FIGS. 31 and 32 where there is shown a developer roller 102' having formed thereon a single spiral groove 148, the turns of which are spaced slightly apart by an elevated surface 150 spaced by an aforesaid gap from the drum. It will be seen that with this arrangement the portion of the liquid developer in any given convolution of the groove 148 of the roller 102' is not fully confined, as is the case where cells 112 are employed. Thus the volume of liquid available for any given pseudopod is in excess of that available with a cell, although not as great as that available with a smooth surfaced roller. Moreover, the provision of a raised portion between adjacent convolutions provides a surface on which a doctor means can ride so as to eliminate all or almost all of the liquid above the top of the groove.

As already pointed out, the electric field image used to create the pseudopods which effect the transfer of liquid developer from the developer roller to an object does not necessarily have to be engendered by an electrostatic image on the object. Alternatively, such an electric field image can be created in situ and in a transitory mode, existing only so long as external means is actuated, to impress a difference of electric potential that forms the electric field image, and is deactivated once the electric field image has served its purpose, namely, the transfer of developer liquid by pseudopods to form a material physical image on the object in conjunction with other pseudopods.

Figure 33:
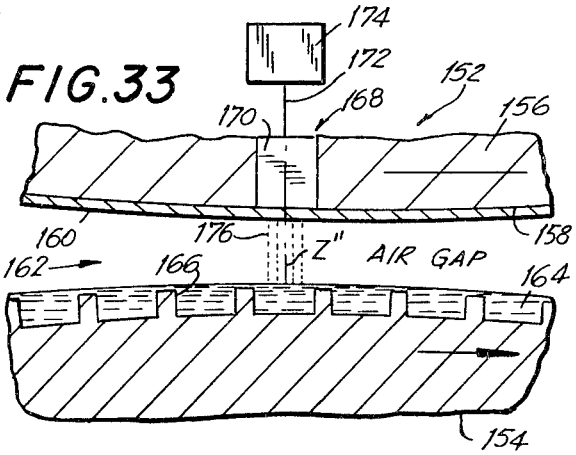
FIG. 33 is a fragmentary transverse sectional view of another embodiment of the invention in which electric field image segments are momentarily created by the application of electric pulses to electrodes.
Figure 34:
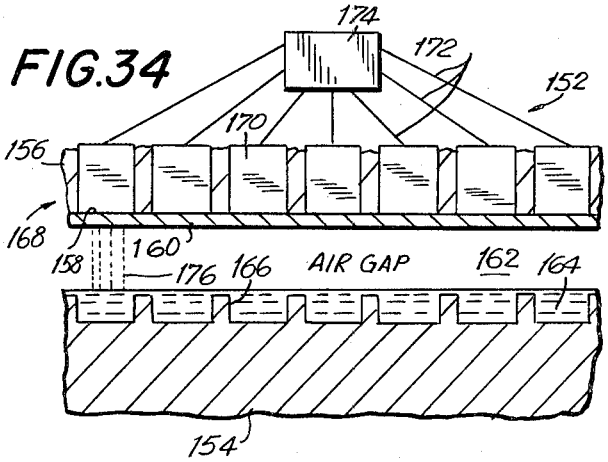
FIG. 34 is a fragmentary axial sectional view of the embodiment shown in FIG. 33.

A structure for forming an evanescent electric field in the configuration of an image is illustrated in FIGS. 33 and 34. This structure, denoted by the reference numeral 152, includes a developer roller 154 which conveniently is of the gravure type as described hereinabove, and a stationary platen 156 having a lower surface 158 which defines a path of travel for a paper copy web 160. Zone Z'' is the zone where development takes place. At this zone there is a small gap 162 between the lower surface of the paper web and the surface of liquid developer 164 in discrete cells 166 that face the platen at the development zone. Discrete cells have been illustrated only by way of example; the development roller in this form of the invention can have any type of surface such as those described heretofore, e.g. a smooth surface or grooved surface.

There are no electrostatic images either on the platen 156 or on the paper copy web 160. In lieu thereof, and to provide the electric field in the shape of physical material images to be formed on the paper web, the platen 156 includes one or more lines 168 of electrically conductive rods, e.g. styli 170, the longitudinal axes of which are perpendicular to the surface of the platen at the development zone Z'', successive styli being so mutually arranged as to define the aforesaid line 168. The styli are of small cross-sectional areas, these being determined by the commercial requirements of the machine and the fineness of image detail desired. A typical transverse dimension of a stylus is in the order of 10 mils. Styli such as described herein are well known in the art of computer printing. Each stylus is electrically connected to a different lead 172. The leads are connected to a pulsing circuit 174, well known in the art of computer printing, which is capable of addressing the styli 170 in a manner such that it will apply electrical potential in the form of pulses to selected styli.

When any particular stylus is thus pulsed, it will create an electric field 176 shown diagrammatically by lines of force in FIG. 34. This field conforms to the configuration of the exposed undersurface of the stylus. When formed, it will, in conjunction with the proximate opposed cell and specifically with the liquid in said cell, causes a pseudopod or group of pseudopods to be raised which will transfer liquid developer from that cell to the exposed surface of web 160 beneath the stylus, thereby creating, in conjunction with other pseudopods, a physical material image.

The pulses for any given stylus at any particular instant of time only exist long enough to insure formation of a pseudopod and transfer of liquid thereby from the developer roller to the web 160. Preferably, immediately thereafter, the pulse collapses. The selection of the styli to be energized and the succession thereof as the web passes beneath them is such as is known in the field of stylus printing, thus causing a plurality of styli-selected pseudopod-formed dots conjointly to define selected images which will usually be in the shape of alpha-numeric symbols or graph lines or areas, although this form of the invention has other uses, e.g. half-tone reproduction.

The paper web must be such that it is capable of having physical material images formed thereon. To prevent interference between the electric fields associated with adjacent styli in the formation of the images by pseudopod transfer, the paper and developer roller preferably move in the same direction as indicated in FIG. 33, and at the same speed. Any of the developers previously discussed can be used with the apparatus 152.

Figure 35:
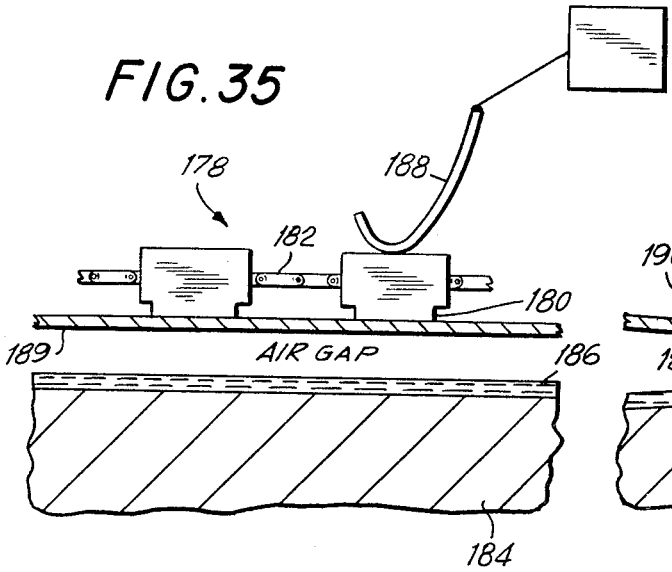
FIG. 35 is a fragmentary axial sectional view of another embodiment of the invention in which an electric field image is momentarily formed by an electrode in the shape of an entire character.
Figure 36:
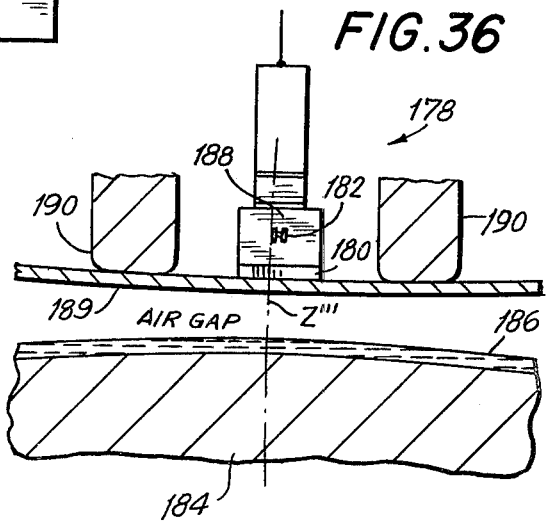
FIG. 36 is a fragmentry transverse sectional view of the embodiment shown in FIG. 35.

Another arrangement for forming an electric field in the configuration of an image to be developed is illustrated in FIGS. 35 and 36 in which the reference numeral 178 denotes an alternate form of equipment for carrying out the present invention. Said equipment 178 includes a chained supply of electrically conductive elements each in the shape of a different character 180. Reference numeral 182 denotes the chain connecting the characters. As is well known in chain printing, there is at least one series of characters including all letters of the alphabet, and all symbols that may be required for printing a text, e.g. alpha-numeric symbols. The chain runs parallel to the axis of rotation of the developer roller 184 which is shown as having a smooth surface. The chain includes links between adjacent characters and which insulate the characters from one another and, indeed, preferably, the chain itself is made of electrically insulating materials. The chain sweeps the characters near to but out of contact with a film 186 of liquid developer brought up to the developing zone Z''' where the developer roller most closely approaches the characters as they are moved across the roller out of contact therewith.

An electric contact 188 is provided which engages characters where physical material images are to be formed. The contact is actuated in proper relationship to cause desired images to be formed on a web 189 of copy material such as paper. The web is guided in a path of movement to and beyond the development zone by stationary elements 190. When a character is energized it causes pseuodopods to be drawn up across the gap at the development zone Z''' from the film of liquid developer 186. For an individual character there will be a multiplicity of such pseudopods. By energizing proper characters as they are at sites to form the desired developed images on the paper, a text or the like will be created. The web 189 may be advanced intermittently and remain stationary for the duration of time required to print a complete line of alpha-numeric symbols. While this printing takes place, the developer roller 184 turns without stopping to provide a constant fresh supply of liquid developer.

The equipment thus far described for effecting a pseudopod transfer has had the object with which the electric field is associated located physically above the surface of the developer liquid at the development zone. The term "above" includes both directly vertically above and in such positions that the vector from the point of generation of the electric field to the surface of the developer liquid includes a downward vertical component. The invention is not, however, restricted to this relative position of the liquid surface and the means for generating an electric field.

Figure 37:
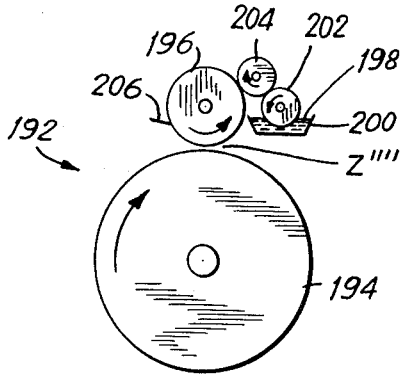
FIG. 37 is a schematic view similar to FIG. 1 in which the developer roller is located above the surface onto which the liquid developer is to be transferred for the creation of a developer image.

In FIG. 37 there is illustrated an apparatus 192 in which the object with which the electric field is associated is below the liquid developer at the development zone Z''''. Said apparatus includes a drum 194 having an electrostatic image thereon, impressed by any of the means heretofore described. Cooperating with the drum is a developer roller 196 which may be either a smooth surfaced roller, a grooved roller or a gravure roller or any other suitable supply for liquid developer. A liquid developer 198 is contained in a tray 200 alongside the developer roller. A pick-up roller 202 turns with a portion of its surface immersed in the liquid developer. The liquid film drawn up from the tray is shifted from the pick-up roller 202 to the developer roller 196 by a transfer roller 204. All the rollers turn at the same surface speed. The roller 196 preferably is driven, as is roller 202. The roller 204 may ride on both of these rollers and be driven thereby. Said roller 204 contacts the surfaces of the pick-up roller and of the developer roller. The transfer roller 204 will supply liquid developer to the developer roller. In the event the developer roller is a grooved or gravure-type roller, the liquid developer will be deposited in the depressions in the developer roller and the liquid developer will be carried out by the developer roller from the point of its application by the transfer roller 204 to the gap at the development zone Z''''. This gap is in the order of magnitude described heretofore. In the event that the developer roller 196 has a smooth surface, the liquid film will tend to maintain a constant thickness as it moves from its point of application at the transfer roller 204 to the development zone due to the surface tension of the liquid. Preferably, a doctor blade 206 is included to control the amount of developer present on the developer roller as it approaches the development zone Z''''.

When the liquid developer on the developer roller approaches the development zone Z'''', it will, as it comes into close enough proximity with the drum, form pseudopods such as those heretofore described. However, these pseudopods will not be drawn from the drum against the force of gravity. The sole force opposing the pseudopods in this form of the invention will be the surface tension of the liquid developer. Gravity will assist in forming the pseudopods and, in this respect, this form of the invention differs from the pseudopod transfer mentioned hereinabove.

It has been stated with respect to the earlier described forms of the invention that the forces of gravity and surface tension aid in preventing pseudopod transfer of liquid in the background areas of electric field images on the object. Where surface tension alone is relied upon to prevent this transfer, the parameters which affect the formation of the pseudopods must be controlled with a closer degree of tolerance so that the tips of the pseudopods only will reach the surface of the object under proper electric field conditions. Where electric field conditions are not sufficient to effect the transfer, the action of surface tension will prevent the background from being developed. Therefore, it is preferred, at present, to use that form of the invention in which the liquid developer is below rather than above the means for creating the electric field image.

Figure 38:
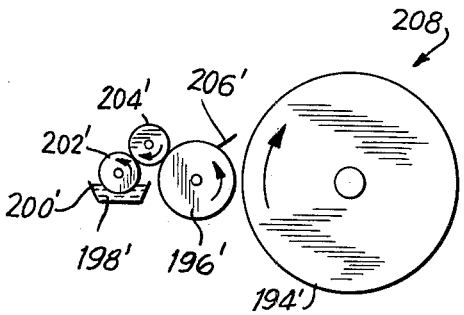
FIG. 38 is a schematic view similar to FIG. 1 in which the developer roller is located in the same horizontal plane as the segment of the surface in which an image is to be developed.

In FIG. 38 there is shown apparatus 208 which is essentially identical to the apparatus 192, except that in the apparatus 208 the axis of rotation of the developer roller is in the same horizontal plane as the axis of rotation of the drum. In view of the similarity between these two apparatuses, the elements of the apparatus 208 are designated by the same reference numerals given for the apparatus 192, except that those of the apparatus 208 are primed.

Figure 39:
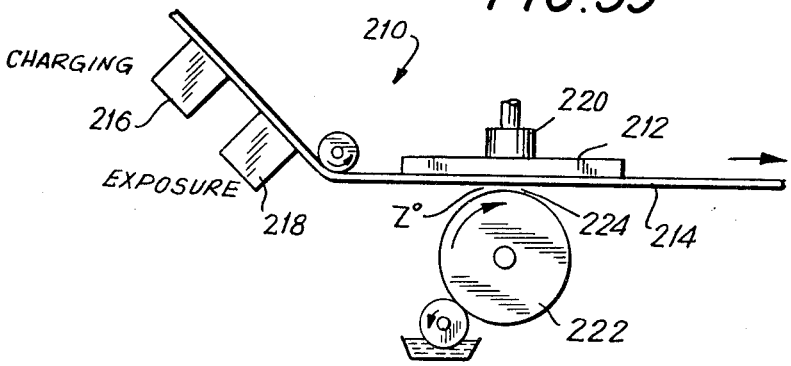
FIG. 39 is a schematic view of another embodiment of the invention in which a developer roller cooperates with a flat plate having an electric field image, transfer of developer taking place across the gap between the developer roller and the plate.

It is not necessary for the electric field image generated by an electrostatic image or by external means to be associated with a cylindrical object such as a drum or curved platen. Such electric field image can be associated, for example, with a flat plate; an apparatus 210 illustrating this arrangement is shown in FIG. 39. Said apparatus includes a flat platen 212 beneath which a web 214 having a lower photoconductive surface is guided. Prior to reaching the platen, the web travels past a charging station 216 and an exposure station 218. A suction box 220 located above the platen at the development zone Z° and having passageways extending through the platen at said zone holds the web in predetermined position flat beneath the platen. A developer roller 222 is located beneath the platen at the development zone and is out of contact with the undersurface of the web although it is closely adjacent, the order of magnitude of the gap 224 between these two elements being such as described heretofore. A liquid film is supplied to the surface of the developer roller in a fashion heretofore described. The surface of the developer roller can be of any of these mentioned previously, for example, gravure type or grooved. Both the web and roller preferably move in the same direction and, optionally, synchronously at the speeds which have been described heretofore in connection with FIG. 1. The apparatus 210 effects pseudopod transfer of the developer liquid in the manner described with reference to FIGS. 2–8 and 21–28.

In all of the various forms of the invention the developer liquid has been described as being brought to the development zone either by capillary means or by a developer roller. The invention, however, is not to be restricted to these particular modes of supply, it sufficing that at the development zone the liquid is present as a body of either large, intermediate or small volume, the surface of which is close to but out of contact with the surface on which a developed image is to be formed, the gap spacing being of the order of magnitude described, and the surface of the liquid being essentially equidistant at the development zone from the surface of the object on which a developed image is to be formed save, of course, for the initiation and formation of pseudopods.

FIG. 40 illustrates an apparatus 226 embodying a modified form of the invention which essentially is the same apparatus as shown in FIG. 1, the supply and take-up rolls and charging and exposure and drying stations being omitted for the sake of simplicity. The sole difference between the apparatus 20 of FIG. 1 and the apparatus 226 of FIG. 40 is the location of the development station 32. It will be recalled that in FIG. 1 the developer roller 40 is directly below the lowest point on the platen 22. In the apparatus 226 the developer roller 40 is angularly spaced from a position directly below the lowermost point of the platen, so that the radial gap between the developer roller and the web 24 is at an angle to the vertical. This angle includes a vector component extending radially downwardly from the web to the developer roller so that the force of gravity plus that of surface tension tend to prevent the tip of a spike and the force of gravity tends to prevent a detached droplet from reaching the photoconductive coating on the web 24 where there is no charged segment.

The drier 33 can be of any conventional construction compatible with the developer liquid and the image carrier. A typical drier is a source of heat.

In the apparatuses described, the images toned (developed) pursuant to the present invention are rendered permanent by drying the same (as by volatilizing the liquid carrier) on the substrate that was toned in the first instance, providing that the substrate is not to be reused, e.g. a substrate such as coated paper rather than a selenium drum. However, as noted previously, the toned image can be transferred to some other substrate and there rendered permanent, e.g. by heating, or by pressure, or by curing.

The particular manner in which the toned image is employed is not a part of the present invention. Various uses can be made of the toned image. Thus, it can be employed, after being rendered permanent, on a substrate such as a sheet on which information is contained, for instance on newspaper, office copies or computer printouts, or it can be used as a lithographic master, such utilizations of a toned image being well known in the art and described, for example, in U.S. Pat. No. 3,990,980. Moreover, a lithographic master can be prepared by transferring the toned image to a substrate where it acts to retain an inked image without the necessity of the swabbing technique mentioned in the aforesaid U.S.L.P.

The present invention is capable of many commercial applications, such as the duplication of graphic material on sheet, for instance, letters, books, drawings, prints, etc., these being in the domain of conventional office reproduction machines. The instant invention also can be used for a wide variety of other purposes. Such applications include: lithographic printing plates on such substrates as paper and metal; offset lithographic plates; decorative panels constituting rigid and flexible substrates such as metal, wood and fabric; name plates—if the name plates are conductive, e.g. metal, the toned image is prepared on a suitable substrate in accordance with the present invention and thereafter is transferred to the metal substrate as indeed is the case for all end products on which the image cannot be electrostatically formed directly; the imaging of printed circuitboards wherein the toned image ultimately deposited on a conductive substrate can be used either as a plating resist or as an etch resist; the conformal overcoating of integrated circuits and circuit boards with a protective insulating layer which effectively encapsulates the same; printing on plastic foils as in flexographic printing; transfer printing onto rigid or flexible paper or aluminum or plastic films; direct imaging on rigid or flexible substrates; the incorporation of sublimable ingredients in the toner and the toned image, which ingredients will enable sublimable transfer of materials such as dyes from an image to a receiving substrate; electrostatic printing of labels; deposition of organic catalysts from toners for use as sites for electroless deposition of copper; inclusion in the toner of nuclei for use with Itek's RS process; and forming resists for use in the preparation of rotogravure or letterpress plates and cylinders.

It thus will be seen that there are provided toners, methods and apparatuses which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention there is claimed as new and desired to be secured by Letters Patent:

1. A method for creating a physical material image at a surface of an object, said method comprising:

(A) providing a liquid developer at a development zone, (B) disposing said surface of said object close to but out of contact with the surface of said liquid developer at said development zone, p0 (C) providing an electric field extending from said object to said surface of said liquid developer at said development zone, (i) said electric field being in the configuration of at least a portion of the image to be formed, (ii) said field being of a strength sufficiently high to transfer at least a portion of said liquid developer to said object, (iii) said field acting on the liquid developer at said zone, (a) to change the shape of said surface opposed to said object at said zone so as to form a multiplicity of closely spaced mechanically unsupported tiny discrete amorphous pseudopods of liquid of individual cross-section smaller than the image, which conjointly are in the shape of said portion of the image and which extend from said surface in a direction toward said object and (b) to contact said object with the liquid at least from the tips of said pseudopods, (D) said liquid at least from the tips of said pseudopods being deposited on said object, conjointly to form a physical material image in the configuration of said portion.

2. A method as set forth in claim 1 wherein the spacing between the surface of said liquid developer and the surface of said object at said development zone is from about 1 ml to about 40 mils.

3. A method as set forth in claim 1 wherein the spacing between the surface of said liquid developer and the surface of said object at said development zone is from about 1 mil to about 15 mils.

4. A method as set forth in claim 1 wherein the spacing between the surface of said liquid developer and the surface of said object at said development zone is about 2 mils.

5. A method as set forth in claim 1 wherein the surface of the developer liquid is below the surface of said object at the development zone.

6. A method as set forth in claim 1 wherein the surface of the developer liquid is above the surface of said object at the development zone.

7. A method as set forth in claim 1 wherein the surface of the developer liquid is in the same horizontal plane as the surface of said object at the development zone.

8. A method as set forth in claim 1 wherein the electric potential difference between the surface of said object and the surface of said liquid developer is between about 100 volts and about 1000 volts.

9. A method as set forth in claim 8 wherein an externally applied electric field is provided between said object and said surface of said liquid developer.

10. A method as set forth in claim 9 wherein said externally applied electric field aids the electric field in the configuration of at least a portion of the image to be formed.

11. A method as set forth in claim 9 wherein the voltage of the externally applied electric field ranges from about $-1000$ to about $+1000$ volts.

12. A method as set forth in claim 1 wherein the liquid from the tips of the pseudopods is detached from said tips and flies to said object under the influence of said field for deposit on said object.

13. A method as set forth in claim 1 wherein the liquid from the tips of the pseudopods contacts said object while still part of the pseudopods.

14. A method as set forth in claim 1 wherein the liquid developer is present as a continuous film at the development zone.

15. A metnod as set forth in claim 1 wherein the liquid developer is present as a continuous film on a rotating cylindrical object at the development zone.

16. A method as set forth in claim 1 wherein the liquid developer is present as a smooth uninterrupted continuous film on a rotating cylindrical object of the development zone.

17. A method as set forth in claim 1 wherein the liquid developer is present as an interrupted body on a rotating cylindrical object at the development zone.

18. A method as set forth in claim 1 wherein the liquid developer is present as a spiral groove on a rotating cylindrical object at the development zone.

19. A method as set forth in claim 1 wherein the liquid developer is present as a multiplicity of spiral grooves on a rotating cylindrical object at the development zone.

20. A method as set forth in claim 1 wherein the liquid developer is present as a multiplicity of discrete tiny cells on a rotating cylindrical object at the development zone.

21. A method as set forth in claim 1 wherein the liquid developer is brought to the development zone by capillary means.

22. A method as set forth in claim 1 wherein the object is a rotary cylinder and wherein the liquid developer is provided at the development zone by another rotary cylinder, both said rotary cylinders being horizontal and parallel and being spaced apart at the development zone.

23. A method as set forth in claim 22 wherein a pair of spaced raised annuli on one of the cylinders rolls on the other cylinder to control the spacing between the two cylinders at the development zone.

24. A method as set forth in claim 22 wherein the cylinders are turned at synchronous speeds.

25. A method as set forth in claim 22 wherein the cylinders are turned at non-synchronous surface speeds that differ from synchronism by an amount not exceeding 20 ft. per minute.

26. A method as set forth in claim 22 wherein the cylinders are turned at non-synchronous surface speeds that differ from one another by up to one ft. per minute.

27. A method as set forth in claim 22 wherein the object rotary cylinder turns at a surface speed not exceeding 400 ft. per minute.

28. A method as set forth in claim 1 wherein the object is a flexible layer and where the object is guided to, through and beyond the development zone.

29. A method as set forth in claim 1 wherein the object is a drum with a photoconductive surface.

30. A method as set forth in claim 1 wherein the liquid developer includes a carrier.

31. A method as set forth in claim 30 wherein the carrier is volatile.

32. A method as set forth in claim 30 wherein the carrier is essentially non-volatile.

33. A method as set forth in claim 32 wherein the carrier is an oil.

34. A method as set forth in claim 33 wherein the carrier is mineral oil.

35. A method as set forth in claim 33 wherein the carrier is silicone oil.

36. A method as set forth in claim 30 wherein the liquid developer also includes opaque solids which are either soluble or insoluble in the carrier.

37. A method as set forth in claim 36 wherein the weight ratio of the insoluble opaque solids to the developer is from 0:100 to 50:100.

38. A method as set forth in claim 30 wherein the carrier has a viscosity of from about 0.3 to about 2000 centipoises.

39. A method as set forth in claim 30 wherein the carrier has a viscosity of from about 0.5 to about 100 centipoises.

40. A method as set forth in claim 30 wherein the carrier has a viscosity of from about 0.5 to about 50 centipoises.

41. A method as set forth in claim 30 wherein the liquid developer has a surface tension of from about 20 to about 75 dynes/cm.

42. A method as set forth in claim 30 wherein the liquid developer has a surface tension of from about 20 to about 70 dynes/cm.

43. A method as set forth in claim 30 wherein the liquid developer has a density of from about 0.7 to about 1.60 g/cc.

44. A method as set forth in claim 30 wherein the liquid developer has a density in the order of 1 g/cc.

45. A method as set forth in claim 30 wherein the liquid developer has a conductivity of from about $10^{-13}$ (ohm-cm)$^{-1}$ to about $10^{-1}$ (ohm-cm)$^{-1}$.

46. A method as set forth in claim 30 wherein the liquid developer has a conductivity of from about $10^{-13}$ (ohm-cm)$^{-1}$ to about $10^{-4}$ (ohm-cm)$^{-1}$.

47. A method as set forth in claim 30 wherein the liquid developer has a conductivity of from about $10^{-13}$ (ohm-cm)$^{-1}$ to about $10^{-1}$ (ohm-cm)$^{-1}$ and a viscosity of from about 0.3 to about 2000 centipoises.

48. A method as set forth in claim 30 wherein the liquid developer has a surface tension of from about 20 to about 75 dynes/cm and a conductivity of from about $10^{-13}$ (ohm-cm)$^{-1}$ to about $10^{-1}$ (ohm-cm)$^{-1}$.

49. A method as set forth in claim 30 wherein the liquid developer has a surface tension of from about 20 to about 75 dynes/cm, a viscosity of from about 0.3 to about 2000 centipoises, and a conductivity of from about $10^{-13}$ (ohm-cm)$^{-1}$ to about $10^{-1}$ (ohm-cm)$^{1}$.

50. A method as set forth in claim 30 wherein the liquid developer has a surface tension of from about 20 to about 75 dynes/cm, a viscosity of from about 0.3 to about 2000 centipoises, a conductivity of from about $10^{-13}$ (ohm-cm)$^{-1}$ to about $10^{-1}$ (ohm-cm)$^{-1}$, and a density of from about 0.7 to about 1.60 g/cc.

51. A method as set forth in claim 30 wherein the liquid developer also includes a conductivity control agent.

52. A method as set forth in claim 30 wherein the liquid developer also includes a polar conductivity control agent.

53. A method as set forth in claim 51 wherein the conductivity control agent is present in an amount of from about 0.1 g/l of developer to about 100 g/l of developer.

54. A method as set forth in claim 30 wherein the liquid developer includes a conductivity control agent selected from the group consisting of ionizable acids, bases and salts soluble in water; organic soluble compounds containing ionizable functional groups including alcohols, phenols, acids, esters, amides, acid halides, halogenated hydrocarbons, amines, aldehydes, ketones, ethers, thioethers, sulfones, sulfoxides, mercaptans, thiophenols, thioesters, disulfides, azos and peroxys; surface active agents including naphthenate, octanoate, palmitate, stearate, oleate, sulfosuccinate and alkyl salicylate salts of sodium, potassium, ammonium, calcium, magnesium, zinc, cobalt, iron, nickel and aluminum; di-2-ethylhexyl sodium sulfosuccinate; ditridecyl sodium sulfosuccinate; aluminum, chronium, zinc and calcium salts of 3,5-dialkylsalicylic acid wherein the alkyl group is propyl, isopropyl, butyl, isobutyl, tertiary butyl, amyl, isoamyl or other alkyl groups up to C-18; aluminum, chromiun, zinc and calcium salts dialkyl gamma-resorcylic acid wherein the alkyl is as above; isopropylamine salt of dodecylbenzene sulfonic acid; aluminum, vanadium and tin dresinates; aluminum stearate; cobalt, iron and manganese octoates; partially imidized polyamine with lubricating-oil-soluble polyisobutylene chains and free secondary amines; lecithin; soya bean oil; aluminum salt of 50—50 by weight mixture of the mono- and di- 2 ethylhexyl esters of phosphoric acid; and a viscous light amber colored liquid composed 50 percent by weight of a terpolymer is kerosene, the terpolymer being 50 percent by weight octadecenyl methacrylate, 40 percent by weight styrene and 10 percent by weight diethylaminoethyl methacrylate.

55. A method as set forth in claim 30 wherein the liquid developer includes a surfactant.

56. A method for creating a physical material image at a surface of an object, said method comprising:

(A) providing a liquid developer at a development zone, (B) disposing said surface of said object close to but out of contact with the surface of said liquid developer at said development zone, (C) providing an electric field extending from said object to said surface of said liquid developer at said development zone, (i) said electric field being in the configuration of at least a portion of the image to be formed, (ii) said field being of a strength sufficiently high to transfer at least a portion of said liquid developer to said object, (iii) said field acting on the liquid developer at said zone, (a) to change the shape of said surface opposed to said object at said zone so as to form a multiplicity of closely spaced mechanically unsupported tiny discrete amorphous pseudopods of liquid of individual cross-section smaller than the image, which conjointly are in the shape of said portion of the image and which extend from said surface in a direction toward said object and (b) to contact said object with the liquid at least from the tips of said pseudopods, (D) said liquid at least from the tips of said pseudopods being deposited on said object discretely and conjoining to form a physical material image in the configuration of said portion.

57. A method for creating a physical material image at a surface of an object, said method comprising:

(A) providing a liquid developer at a development zone, (B) disposing said surface of said object close to but out of contact with the surface of said liquid developer at said development zone, (C) providing an electric field extending from said object to said surface of said liquid developer at said development zone, (i) said electric field being in the configuration of at least a portion of the image to be formed, (ii) said field being of a strength sufficiently high to transfer at least a portion of said liquid developer to said object, (iii) said field acting on the liquid developer at said zone, (a) to change the shape of said surface opposed to said object at said zone so as to form a multiplicity of closely spaced mechanically unsupported tiny discrete amorphous pseudopods of liquid of individual cross-section smaller than the image, which conjointly are in the shape of said portion of the image and which extend from said surface in a direction toward said object and (b) to contact said object with the liquid at least from the tips of said pseudopods, (D) said liquid at least from the tips of said pseudopods being deposited on said object discretely and blending to form a physical material image in the configuration of said portion.

58. A method for creating a physical material image at a surface of an object, said method comprising:

(A) providing a liquid developer at a development zone, (B) disposing said surface of said object close to but out of contact with the surface of said liquid developer at said development zone, (C) providing an electric field extending from said object to said surface of said liquid developer at said development zone, (i) said electric field being in the configuration of at least a portion of the image to be formed, (ii) said field being of a strength sufficiently high to transfer at least a portion of said liquid developer to said object, (iii) said field acting on the liquid developer at said zone, (a) to change the shape of said surface opposed to said object at said zone so as to form a multiplicity of closely spaced mechanically unsupported tiny discrete amorphous psuedopods of liquid of individual cross-section smaller than the image, which conjointly are in the shape of said portion of the image and which extend from said surface in a direction toward said object and (b) to contact said object with the liquid at least from the tips of said pseudopods, (D) said liquid at least from the tips of said pseudopods being deposited on said object, conjointly to form a physical material image in the configuration of said portion, (E) the liquid deposited on the object from each pseudopod being a droplet having a transverse dimension of from about 0.5 to about 50 mils.

59. A method for creating a physical material image at a surface of an object, said method comprising:

(A) providing a liquid developer at a development zone, (B) disposing said surface of said object close to but out of contact with the surface of said liquid developer at said development zone, (C) providing an electric field extending from said object to said surface of said liquid developer at said development zone, (i) said electric field being in the configuration of at least a portion of the image to be formed, (ii) said field being of a strength sufficiently high to transfer at least a portion of said liquid developer to said object, (iii) said field acting on the liquid developer at said zone, (a) to change the shape of said surface opposed to said object at said zone so as to form a multiplicity of closely spaced mechanically unsupported tiny discrete amorphous pseudopods of liquid of individual cross-section smaller than the image, which conjointly are in the shape of said portion of the image and which extend from said surface in a direction toward said object and have a transverse dimension at their tips in the order of 1 mil, and (b) to contact said object with the liquid at least from the tips of said pseudopods, (D) said liquid at least from the tips of said pseudopods being deposited on said object, conjointly to form a physical material image in the configuration of said portion.

60. A method for creating a visible image at a surface of an object, said method comprising:

(A) providing a liquid developer at a development zone, (B) disposing said surface of said object close to but out of contact with the surface of said liquid developer at said development zone, (C) providing an electrostatic image having associated therewith an electric field extending from said object to said surface of said liquid developer at said development zone, (i) said electric field being in the configuration of at least a portion of the image to be formed, (ii) said field being of a strength sufficiently high to transfer at least a portion of said liquid developer to said object, (iii) said field acting on the liquid developer at said zone, (a) to change the shape of said surface opposed to said object at said zone so as to form a multiplicity of closely spaced mechanically unsupported tiny discrete amorphous pseudopods of liquid of individual cross-section smaller than the image, which conjointly are in the shape of said portion of the image and which extend from said surface in a direction toward said object and (b) to contact said object with the liquid at least from the tips of said pseudopods, (D) said liquid at least from the tips of said pseudopods being deposited on said object, conjointly to form a visible image in the configuration of said portion.

61. A method as set forth in claim 60 wherein the spacing between the surface of said liquid developer and the surface of said object at said development zone is from about 1 mil to about 15 mils.

62. A method as set forth in claim 60 wherein the electric potential difference between the surface of said object and the surface of the liquid developer is not less than 100 volts.

63. A method for developing an electrostatically charged image on a member by passing the image-bearing member above and close to but out of contact with a surface of a liquid developer at a development zone, the surface of the liquid developer at the development zone being spaced from the image-bearing member and the surface of the liquid developer at the development zone being between 1 and 40 mils, the liquid developer having a viscosity of 0.3 to 2000 centipoises, a surface tension of 20 to 75 dynes/cm, a conductivity range of from about $10^{-13}$ (ohm-cm)$^{-1}$ to about $10^{-1}$ (ohm-cm)$^{-1}$, and a density of from about 0.7 to 1.60 g/cc, and the electrostatic image having a surface potential of at least 100 volts, portions of the surface of the liquid developer at the development zone opposed to charged segments of the image jetting toward the segments under the influence of the charges on the segments as closely spaced amorphous tiny discrete pseudopods perpendicular to the film and to the image-bearing member, the liquid from the tips of such pseudopods reaching the charged segments, while liquid in any pseudopods formed in opposition to uncharged segments at the development zone is prevented from reaching the uncharged segments.

64. A method as set forth in claim 63 wherein the electrostatic image and the surface of the liquid developer approach each other toward the development zone and then recede from each other.

65. A method as set forth in claim 63 wherein an external electrostatic field is applied across the development zone.

66. A method as set forth in claim 65 wherein the external field is in the same direction as that created by the electrostatic image.

67. A method as set forth in claim 66 wherein a voltage is applied across the space at the development zone in the range of from −1000 volts to +1000 volts to create the external field.

68. A method as set forth in claim 67 wherein the voltage is in the range of from 100 to 1000 volts.

69. A method as set forth in claim 63 wherein there is no externally applied field.

70. A method as set forth in claim 63 wherein the relative speeds of movement of the electrostatic image and of the surface of the liquid developer at the development zone are in the range of from 0 to 20 feet per minute.

71. A method as set forth in claim 70 wherein the speed of movement of the electrostatic image at the development zone is about 1 foot per minute faster than the speed of movement of the developer liquid at said zone.

72. A method as set forth in claim 70 wherein the speed of movement of the electrostatic image at the development zone is in the range of from 20 feet per minute to 150 feet per minute.

73. A method as set forth in claim 63 wherein liquid developer is brought to the development zone by a roller as a film on the cylindrical surface thereof.

74. A method as set forth in claim 73 wherein the thickness of the film of liquid developer on the roller is in the range from ½ to 10 mils.

75. A method as set forth in claim 73 wherein the thickness of the film of liquid developer on the roller is about 1.5 mils.

76. A method as set forth in claim 63 wherein the space between the electrostatic image and the surface of the liquid developer at the development zone is not more than 20 mils.

77. A method as set forth in claim 63 wherein the electrostatic image is supported at the development zone by a rotary platen and the liquid developer is brought to the development zone by a rotating developer roller, the axes of rotation of the platen and of the roller being horizontal and parallel, and the axis of rotation of the platen substantially vertically above the axis of rotation of the developer roller.

78. A method as set forth in claim 63 wherein the electrostatic image is supported at the development zone by a rotary platen and the liquid developer is brought to the development zone by a rotating developer roller, the axes of rotation of the platen and of the roller being horizontal and parallel, and the axis of rotation of the developer roller being angularly displaced from a position vertically below the axis of rotation of the platen.

79. A method as set forth in claim 63 wherein the liquid from the tips of the pseudopods reaches the member as droplets the sizes of which range from 0.5 to 50 mils.

80. A method as set forth in claim 63 wherein the tips of the pseudopods touch segments of the image at the development zone and subsequently droplets break away from the tips and remain at the sites of the segments.

81. A method as set forth in claim 63 wherein as the pseudopods reach the development zone the tips thereof opposed to segments of the image become detached from the pseudopods to form droplets which travel to the segments of the image and remain at the sites of the segments.

82. A method as set forth in claim 63 wherein a body of liquid developer is provided which is raised toward the development zone by capillary action but remains out of contact with electrostatic images at said zone except for the jetting of the pseudopods.

83. A method as set forth in claim 63 wherein the liquid developer is an aqueous liquid.

84. A method as set forth in claim 82 wherein the liquid developer also includes a coloring agent.

85. A method as set forth in claim 84 wherein the coloring agent is a dye.

86. A method as set forth in claim 84 wherein the coloring agent is a pigment.

87. A method as set forth in claim 63 wherein the liquid developer is an organic liquid.

88. A method as set forth in claim 87 wherein the liquid developer also includes a coloring agent.

89. A method as set forth in claim 88 wherein the coloring agent is a dye.

90. A method as set forth in claim 87 wherein the coloring agent is a pigment.

* * * * *

UNITED STATES PATENT AND TRADEMARK OFFICE

CERTIFICATE OF CORRECTION

PATENT NO. : 4,268,597

DATED : May 19, 1981

INVENTOR(S) : Irving L. Klavan, et al

It is certified that error appears in the above—identified patent and that said Letters Patent is hereby corrected as shown below:

On the Title page Item [63] Related U. S. Application Data should read as follows:

-- continuation-in-part of Ser. No. 676,463, Apr. 13, 1976, abandoned, Ser. No. 916,041, Jun. 29, 1978, Pat. No. 4,202,620, and Ser. No. 916,042, Jun. 29, 1978, Pat. No. 4,202,913 --.

Signed and Sealed this

Thirtieth Day of March 1982

[SEAL]

Attest:

GERALD J. MOSSINGHOFF

Attesting Officer

Commissioner of Patents and Trademarks